US010330392B2

(12) United States Patent
Liu et al.

(10) Patent No.: US 10,330,392 B2
(45) Date of Patent: Jun. 25, 2019

(54) THREE-DIMENSIONAL HEAT TRANSFER DEVICE

(71) Applicant: COOLER MASTER CO., LTD., New Taipei (TW)

(72) Inventors: Lei-Lei Liu, New Taipei (TW); Xiao-Min Zhang, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 0 days.

(21) Appl. No.: 16/159,398

(22) Filed: Oct. 12, 2018

(65) Prior Publication Data

US 2019/0049190 A1 Feb. 14, 2019

Related U.S. Application Data

(63) Continuation-in-part of application No. 15/257,805, filed on Sep. 6, 2016, now Pat. No. 10,126,069.

(30) Foreign Application Priority Data

Feb. 5, 2016 (CN) ..... 2016 1 0082174
Jul. 19, 2018 (CN) ..... 2018 1 0794973

(51) Int. Cl.
*F28F 1/32* (2006.01)
*F28D 15/02* (2006.01)
*F28D 15/04* (2006.01)

(52) U.S. Cl.
CPC ..... *F28D 15/046* (2013.01); *F28D 15/0266* (2013.01); *F28F 1/325* (2013.01)

(58) Field of Classification Search
CPC .... F28D 15/04; F28D 15/0266; F28D 15/046; F28D 2021/0028; F28D 2021/0029; F28F 1/32; H01L 23/40; H01L 23/46; H01L 23/473; H01L 23/4735
USPC ..... 165/80.4, DIG. 531
See application file for complete search history.

(56) References Cited

U.S. PATENT DOCUMENTS 3,255,702 A 6/1966 Gehrm
3,746,081 A * 7/1973 Corman ..... F28D 15/046 165/104.26
6,302,192 B1 * 10/2001 Dussinger ..... F28D 15/0233 165/104.21
6,382,309 B1 * 5/2002 Kroliczek ..... F28D 15/0233 165/104.26
6,738,257 B1 * 5/2004 Lai ..... F28D 15/0266 165/104.26
6,938,680 B2 * 9/2005 Garner ..... F28D 15/04 165/104.26
2003/0010477 A1 1/2003 Khrustalev et al.
(Continued)

FOREIGN PATENT DOCUMENTS

CN 100470776 C 3/2009
TW M517314 U 2/2016

*Primary Examiner* — Justin M Jonaitis
(74) *Attorney, Agent, or Firm* — McDermott Will & Emery LLP

(57) ABSTRACT

A three-dimensional heat transfer device includes a vapor chamber comprising a chamber body and a first capillary structure, and the first capillary structure being disposed in the chamber body; and a heat pipe comprising a pipe body and a second capillary structure, and the second capillary structure being disposed in the pipe body. The first capillary structure is connected to the second capillary structure by metallic bonding.

35 Claims, 20 Drawing Sheets

(56) References Cited

U.S. PATENT DOCUMENTS

| | | | | |
|---|---|---|---|---|
| 2004/0118553 | A1* | 6/2004 | Krassowski | C04B 41/009 165/104.26 |
| 2005/0173098 | A1* | 8/2005 | Connors | F28D 15/02 165/104.33 |
| 2007/0272399 | A1* | 11/2007 | Nitta | F28D 15/0233 165/185 |
| 2008/0036076 | A1 | 2/2008 | Ouyang | |
| 2008/0144319 | A1* | 6/2008 | Chang | B82Y 10/00 362/294 |
| 2011/0000649 | A1 | 1/2011 | Joshi et al. | |
| 2017/0176112 | A1 | 6/2017 | Sarraf et al. | |

* cited by examiner

THREE-DIMENSIONAL HEAT TRANSFER DEVICE

CROSS-REFERENCE TO RELATED APPLICATIONS

This non-provisional application is a continuation-in-part application of U.S. application Ser. No. 15/257,805, filed on Sep. 6, 2016, which claims priority under 35 U.S.C. § 119(a) to Application No. 201610082174.6 filed Feb. 5, 2016, in the Chinese National Intellectual Property Administration (CNIPA), the entire contents of both these applications are hereby incorporated by reference. This continuation-in-part application also claims priority under 35 U.S.C. § 119(a) to Application No. 201810794973.5 filed Jul. 19, 2018, in the Chinese National Intellectual Property Administration (CNIPA), the entire contents of which are hereby incorporated by reference.

TECHNICAL FIELD

The present disclosure relates to a heat transfer device and, in particular, to a three-dimensional heat transfer device.

BACKGROUND

In regard to heat transfer, in order to dissipate heat generated from heating elements, conventional heat transfer devices utilize a heat conduction plate and a heat pipe to transfer heat, and cooling devices (e.g. fins and fans) are also utilized to dissipate heat, as described below.

The heat conduction plate is in contact with the heating element, the heat pipe is connected between the heat conduction plate and the cooling device, so that the heat generated from the heating element is transferred to the heat conduction plate first, and then the heat is transferred from the heat conduction plate to the cooling device via the heat pipe for heat dissipation.

However, the heat conduction plate and the heat pipe in the conventional heat transfer device work individually, and a capillary structure of the heat conduction plate is not connected to the capillary structure of the heat pipe. As a result, the heat conduction plate or the heat pipe transfers heat individually in a plane manner instead of an overall three-dimensional manner. In other words, heat dissipation is not achieved well.

Accordingly, the inventor made various studies to overcome the above problems, on the basis of which the present disclosure is accomplished.

SUMMARY

According to example embodiments, a three-dimensional heat transfer device includes a vapor chamber and a heat pipe. The vapor chamber includes a chamber body and a first capillary structure, and the first capillary structure is disposed in the chamber body. The heat pipe includes a pipe body and a second capillary structure, and the second capillary structure is disposed in the pipe body. The first capillary structure is connected to the second capillary structure by metallic bonding.

According to example embodiments, a three-dimensional heat transfer device includes a vapor chamber, a heat pipe and a bonding layer. The vapor chamber includes a chamber body and a first capillary structure, and the first capillary structure is disposed in the chamber body. The heat pipe includes a pipe body and a second capillary structure, and the second capillary structure is disposed in the pipe body. The bonding layer is connected to the first capillary structure and the second capillary structure. The bonding layer includes a porous structure.

According to example embodiments, a method of manufacturing a three-dimensional heat transfer device includes providing a vapor chamber comprising a first capillary structure; providing a metal powder on at least part of the first capillary structure; contacting a heat pipe including a second capillary structure to the metal powder; and performing a sintering process to sinter the metal powder to form a bonding layer. The bonding layer is connected to the first capillary structure and the second capillary structure by metallic bonding.

According to example embodiments, a method of manufacturing a three-dimensional heat transfer device includes providing a vapor chamber comprising a first capillary structure, providing a metal powder on at least part of the first capillary structure, contacting a heat pipe including a second capillary structure on the metal powder, and performing a sintering process to sinter the metal powder to form a bonding layer including a porous structure. The bonding layer is connected to the first capillary structure and the second capillary structure.

BRIEF DESCRIPTION OF THE DRAWINGS

The disclosure will become more fully understood from the detailed description, and the drawings provided herein are for illustration only, and thus do not limit the disclosure, wherein.

DETAILED DESCRIPTION

Detailed descriptions and technical contents of the present disclosure are illustrated below in conjunction with the accompany drawings. However, it is to be understood that the descriptions and the accompany drawings disclosed herein are merely illustrative and exemplary and not intended to limit the scope of the present disclosure.

Figure 5:
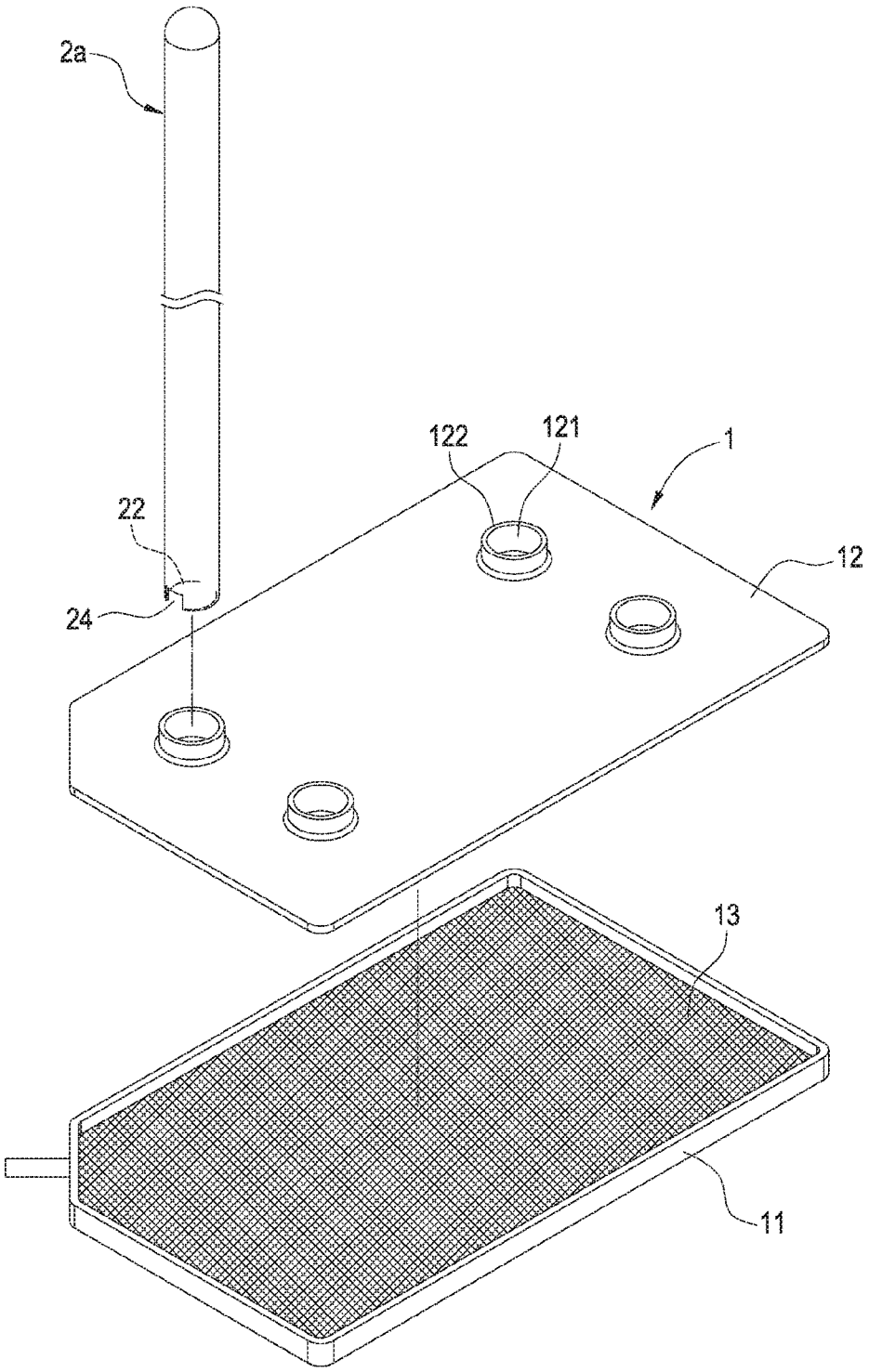
FIG. 5 is a perspective exploded view according to the second embodiment of the present disclosure.
Figure 6A:
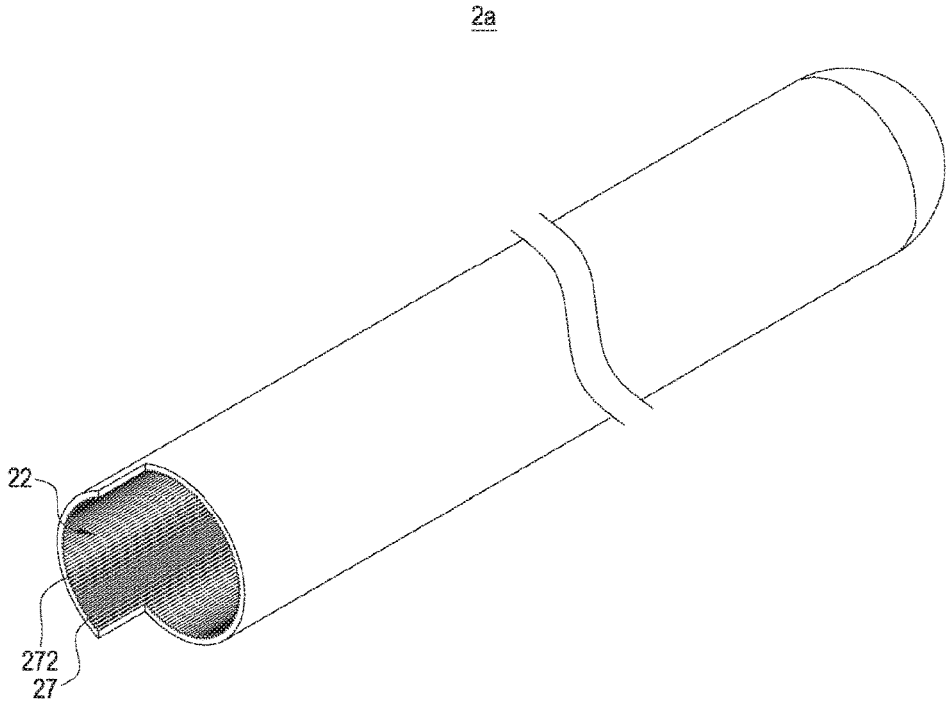
FIG. 6A is a perspective view from another viewing angle illustrating a heat pipe of the first type according to the second embodiment of the present disclosure.
Figure 6B:
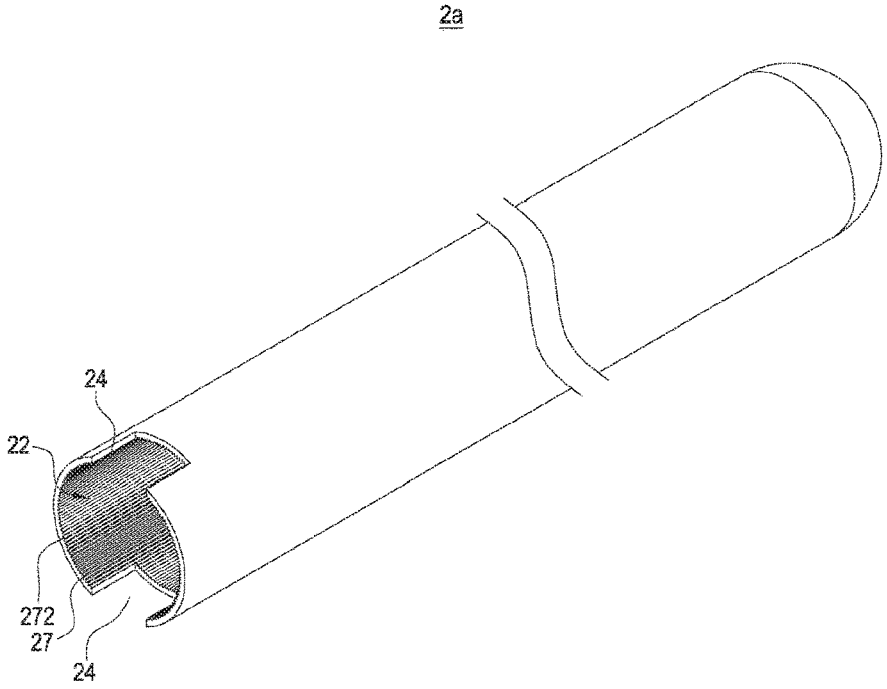
FIG. 6B is a perspective view from another viewing angle illustrating the heat pipe of the second type according to the second embodiment of the present disclosure.
Figure 7:
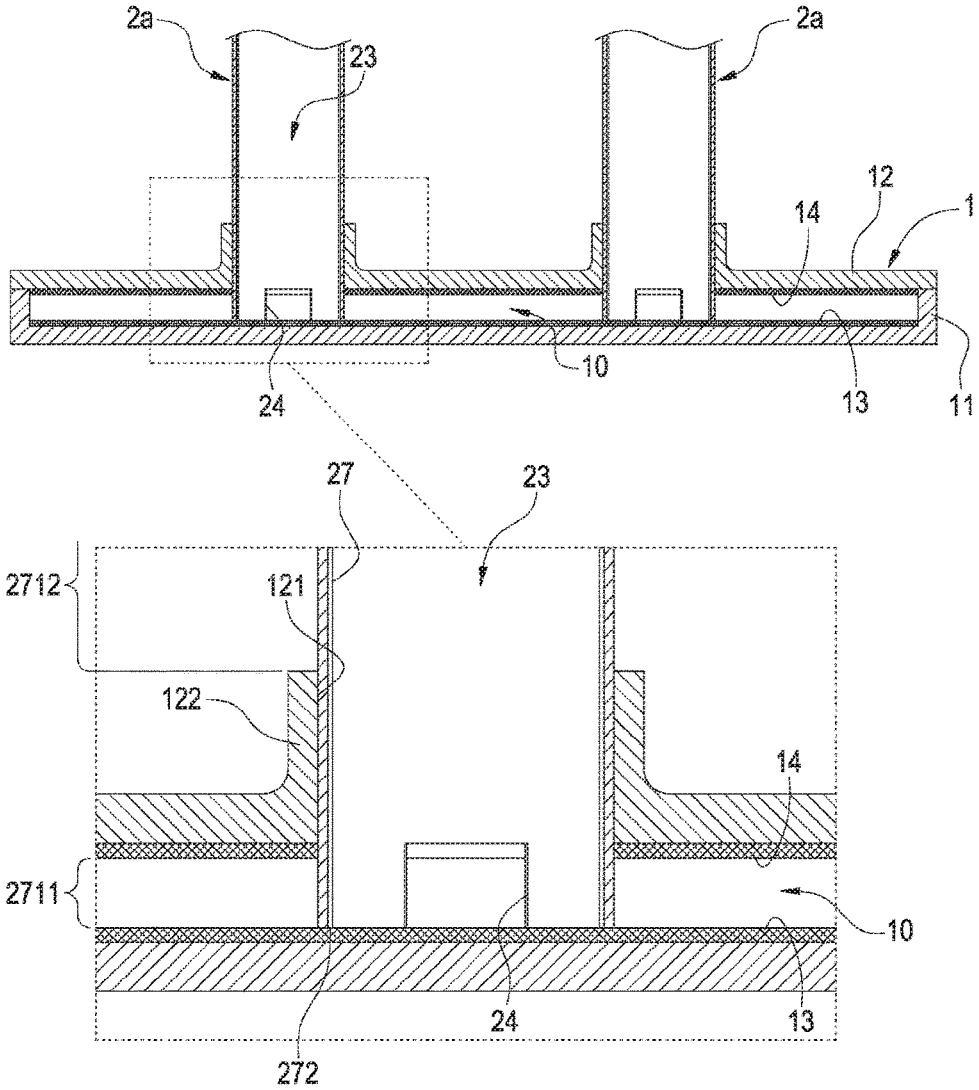
FIG. 7 is a cross-sectional view and also a partially enlarged view illustrating the second embodiment of the present disclosure after assembly.

The present disclosure provides a three-dimensional heat transfer device. FIGS. 1 to 4 show the first embodiment of the present disclosure, and FIGS. 5 to 7 show the second embodiment of the present disclosure.

As shown in FIGS. 1 to 4, according to the first embodiment of the present disclosure, the three-dimensional heat transfer device includes a vapor chamber 1, at least one heat pipe 2 and a working fluid flowing inside the vapor chamber 1 and the heat pipe 2.

The vapor chamber 1 has a first plate 11 and a second plate 12 opposite to each other, and a cavity 10 is formed between the first plate 11 and the second plate 12. The vapor chamber 1 can be an integral structure and also can be a combined structure. In the present embodiment, the combined structure disclosed therein is merely representative for purposes of describing an example of the present disclosure. That is to say, the second plate 12 can be assembled to the first plate 11 to form the vapor chamber 1 having the cavity 10 inside.

A first capillary structure 13 is disposed on an inner surface of the first plate 11, a third capillary structure 14 (see FIG. 4) is disposed on an inner surface of the second plate 12, and the first and third capillary structures 13, 14 face each other. The first and third capillary structures 13, 14 can include sintered powder, sintered ceramic powder, metal web, or metal groove, and the present disclosure is not limited in this regard. However, in some embodiments, an inner surface of the second plate 12 is not disposed with the third capillary structure 14. In other words, only the inner surface of the first plate 11 is disposed with the capillary structure (i.e. the first capillary structure 13).

The second plate 12 forms at least one insertion hole 121. In the present embodiment, there are multiple insertion holes 121 for purposes of describing an example. Therefore, there are also multiple heat pipes 2 corresponding in number to the number of the insertion holes 121. Furthermore, a flange 122 in a circular form extends outwardly from a periphery of each insertion hole 121, thereby facilitating fixed connection with the heat pipe 2.

The heat pipe 2 is a hollow tube which has a second capillary structure 21 disposed inside, and the second capillary structure 21 has a contact portion 212 extending out of the heat pipe 2 to be exposed. In the present embodiment, one end (hereinafter referred to as the insertion end but not labelled) of the heat pipe 2 forms an opening 22 (see FIG. 3), the second capillary structure 21 includes two capillary elements 211 (see FIG. 4) arranged spaced apart and side by side so as to form a vapor passage 23 between the two capillary elements 211. Each of the two capillary elements 211 includes an exposed section 2111, the contact portion 212 consists of the exposed section 2111 of each of the two capillary elements 211, and thereby the vapor passage 23 of the heat pipe 2 communicates with the cavity 10 by means of the contact portion 212. The second capillary structure 21 can include sintered powder, ceramic powder, metal web or metal grooves, and the present disclosure is not limited in this regard. In the present embodiment, the second capillary structure 21 includes sintered powder for purposes of describing an example of the present disclosure.

Each heat pipe 2 is inserted through each insertion hole 121 correspondingly to be erected on the second plate 12, and the insertion end of the heat pipe 2 is utilized for insertion, so that the opening 22 is exposed within the cavity 10. The contact portion 212 of the second capillary structure 21 extends out from the opening 22 to be exposed, so the contact portion 212 extends into the cavity 10 to be connected to the first capillary structure 13, and thereby the first and second capillary structures 13, 21 communicate with each other.

In the present embodiment, for purposes of describing clear examples, the insertion end of the heat pipe 2 is inserted into the cavity 10 to contact a bottom thereof, so as to make the contact portion 212 in stable contact with the first capillary structure 13, and thereby the first and second capillary structures 13, 21 communicate with each other.

Each heat pipe 2 is inserted through the second plate 12 for fixed connection therewith by any suitable method such as making an outer wall surface of each heat pipe 2 in contact with the flange 122 and soldered thereto, thereby enhancing structural stability between the heat pipe 2 and the vapor chamber 1. Each heat pipe 2 is vertically inserted through the second plate 12, or the heat pipe 2 can form an included angle of 70 to 110 degrees with the second plate 12. The heat pipe 2 intersects the second plate 12, no matter whether the heat pipe 2 is vertically inserted or forms the included angle.

Figure 1:
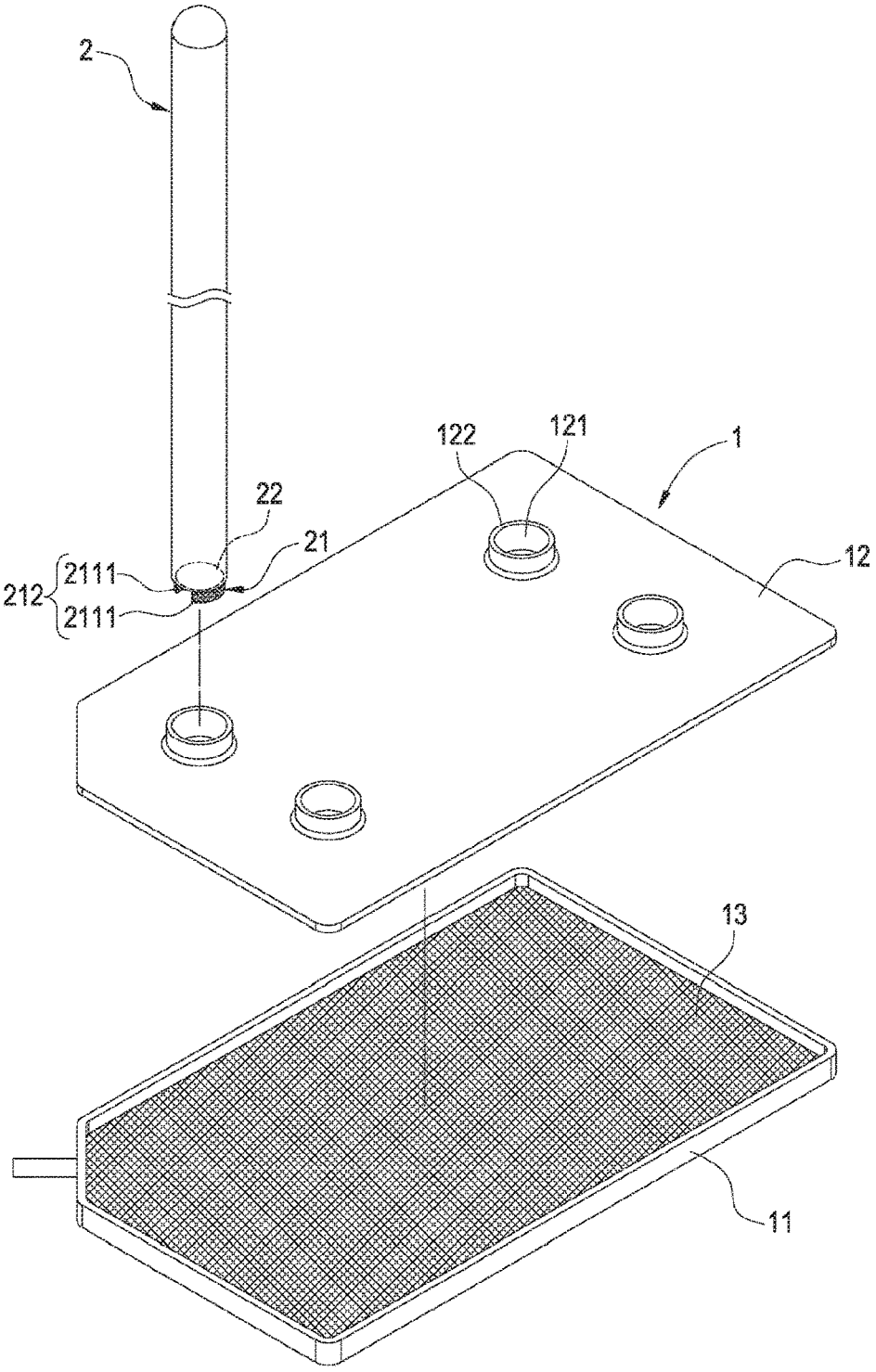
FIG. 1 is a perspective exploded view according to the first embodiment of the present disclosure.
Figure 2:
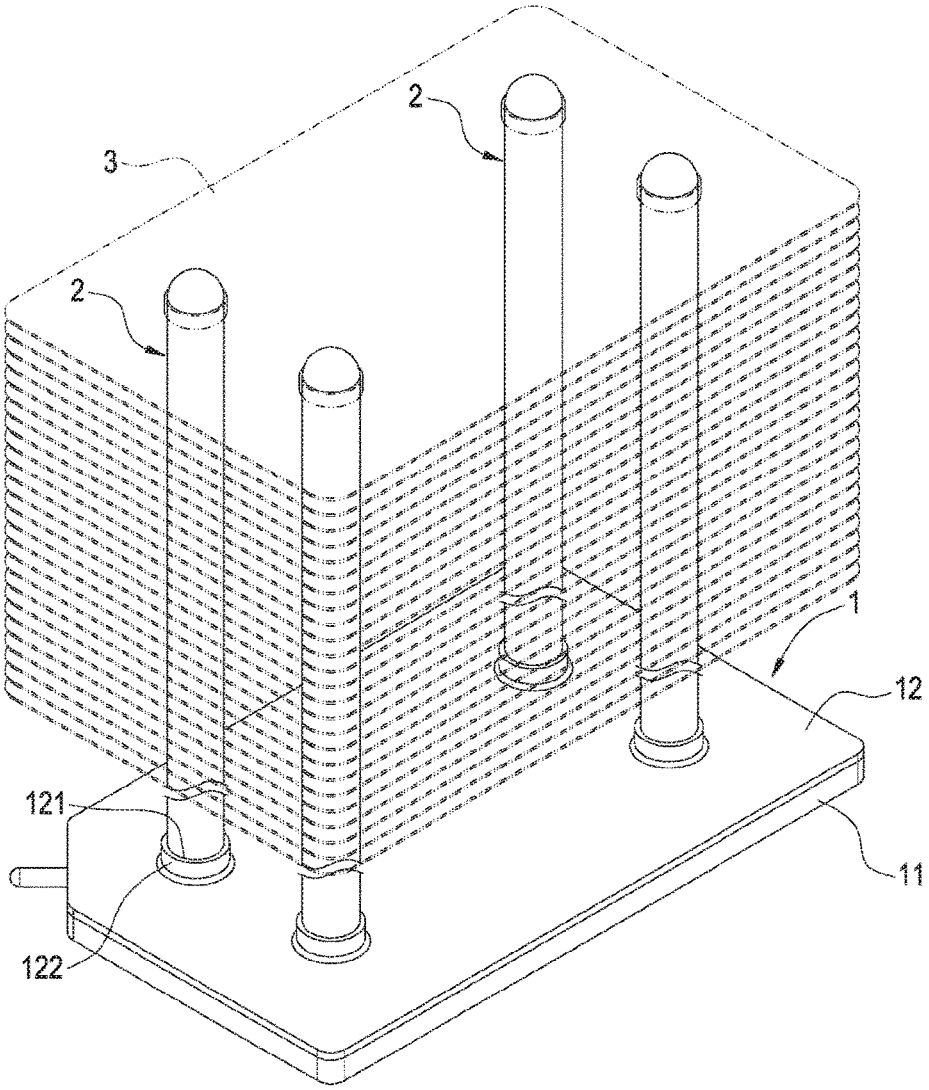
FIG. 2 is a perspective assembled view according to the first embodiment of the present disclosure.
Figure 3:
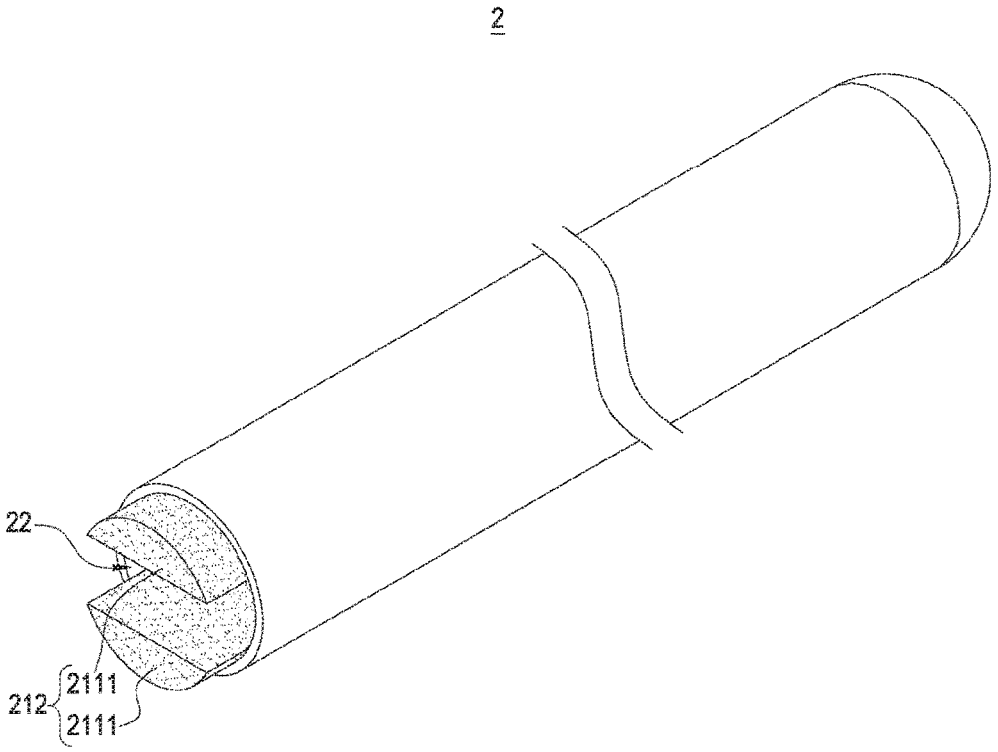
FIG. 3 is a perspective view from another viewing angle illustrating a heat pipe according to the first embodiment of the present disclosure.
Figure 4:
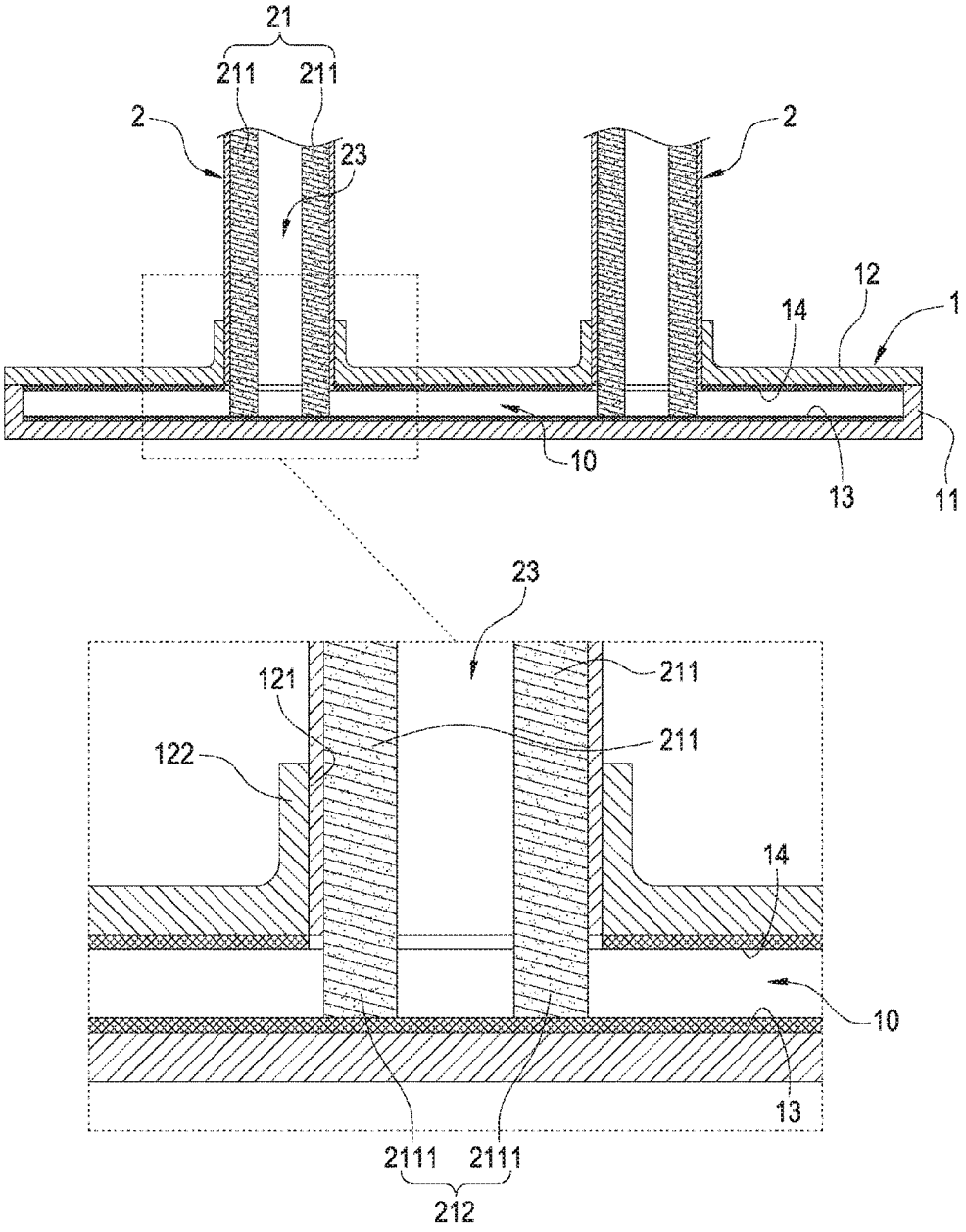
FIG. 4 is a cross-sectional view and also a partial enlarged view of FIG. 2 according to the first embodiment of the present disclosure.

As shown in FIGS. 2 and 4, the heat pipe 2 inserted into the cavity of the vapor chamber 1 is in an erected condition, and the second capillary structure 21 inside the heat pipe 2 and the first capillary structure 13 inside the vapor chamber 1 contact and communicate with each other. As a result, an overall three-dimensional heat transfer effect can be achieved, thus desired ideal heat dissipation can be effected.

In addition, the two capillary elements 211 of the second capillary structure 21 and the two exposed sections 2111 thereof are spaced apart to form the vapor passage 23, so when the contact portion 212 of the heat pipe 2 is in contact with the first capillary structure 13, vapor can circulate via the vapor passage 23, and a hollow space inside the heat pipe 2 communicates with the cavity 10 of the vapor chamber 1, thereby enhancing heat dissipation. Certainly, after the contact portion 212 extending out of the heat pipe 2 and exposed therefrom is inserted into the cavity 10, a portion of the heat pipe 2, having the contact portion 212 extending out, also communicates with the cavity 10, thus having a function similar to the vapor passage 23.

In addition to contacting and communicating with the first capillary structure 13, the second capillary structure 21 of each heat pipe 2 can also connect and communicate with the third capillary structure 14. In fact, just by making the second capillary structure 21 contact and communicate with the first capillary structure 13, the second capillary structure 21 can dissipate heat properly.

Furthermore, as shown in FIG. 2, the three-dimensional heat transfer device can further include a fin set 3. The fin set 3 is assembled onto the heat pipe 2, so that the heat of the heat pipe 2 can be transferred to the fin set 3, thereby facilitating dissipating the heat of the fin set 3 by a fan not illustrated in the drawing.

FIGS. 5 to 7 illustrate the three-dimensional heat transfer device according to the second embodiment of the present disclosure. The second embodiment is similar to the first embodiment with the difference that the heat pipe 2*a* in the second embodiment is different from the heat pipe 2 in the first embodiment, as more fully detailed below.

The heat pipe 2*a* (see FIG. 7) includes an inner section 2711 inside the cavity 10, an outer section 2712 outside the cavity 10, and an insertion section (not labelled) connected between the inner section 2711 and the outer section 2712 and fixed to the flange 122. A portion of the inner section 2711 forms an opening 22, and the opening 22 can be circular, rectangular or can be of a tear drop shape; the present disclosure is not limited in this regard. The opening 22 can be enlarged from a tube end (i.e. the insertion end) of the heat pipe 2*a* to a tube body to also permit circulation of the vapor (as shown in FIG. 6A). Alternatively, the opening 22 can be formed first, and then a plurality of gaps 24 (as shown in FIG. 5 or FIG. 6B) are formed directly on the tube body, so that the gaps 24 can serve as a vapor opening for the vapor to circulate therethrough. To be specific, the opening 22 is formed at a free end (i.e. the insertion end of the heat pipe 2*a*) of the inner section 2711, each gap 24 is formed at the inner section 2711 (which is also the tube body of the heat pipe 2*a*), and the gaps adjoin the opening 22 to communicate with each other, so the gaps 24 can serve as the vapor opening for the vapor to circulate therethrough.

The heat pipe in the second embodiment can be the heat pipe 2*a* of the first type in FIG. 6A and can also be the heat pipe 2*a* of the second type in FIG. 6B; the present disclosure is not limited in this regard, although for the purpose of describing the second embodiment, the heat pipe 2*a* of the second type shown in the FIG. 6B is taken as an example.

The second capillary structure 27 includes a contact portion 272 which is arranged in the opening 22 and exposed. In the present embodiment, the contact portion 272 is a rim of the second capillary structure 27, which is exposed corresponding to the opening 22. The contact portion 272 can be flush with or slightly shrink inwardly into the free end (or into the insertion end of the heat pipe 2*a*) of the inner section 2711.

The heat pipe 2*a* is vertically inserted through the second plate 12, and the inner section 2711 extends into the cavity 10, so that the contact portion 272 can be connected to the first capillary structure 13 via the opening 22 to make the first and second capillary structures 13, 27 communicate with each other. To be specific, the inner section 2711 contacts, by its free end, the first capillary structure 13, and therefore the contact portion 272 together with the inner section 2711 contacts the first capillary structure 13.

In summary, compared with conventional techniques, the present disclosure provides the following advantages. By making the second capillary structure 21, 27 of the heat pipe 2, 2*a* connected and communicating with the first capillary structure 13 of the vapor chamber 1, overall three-dimensional heat transfer is achieved, and a desired optimized heat dissipation effect can be obtained when the vapor chamber 1 collaborates with the heat pipe 2, 2*a*.

The present disclosure further has other advantages. By spacing the two capillary elements 211 to be apart from each other to form the vapor passage 23 or by forming the opening 22 of the heat pipe 2*a*, a hollow space inside the heat pipe 2, 2*a* is in communication with the cavity 10 of the vapor chamber 1, thereby promoting heat dissipation. Certainly, after the contact portion 212 extending out of the heat pipe 2 and exposed therefrom is inserted into the cavity 10, a portion of the heat pipe 2, having the contact portion 212 extending out, also communicates with the cavity 10, thus achieving an effect similar to the vapor passage 23.

Figure 8:
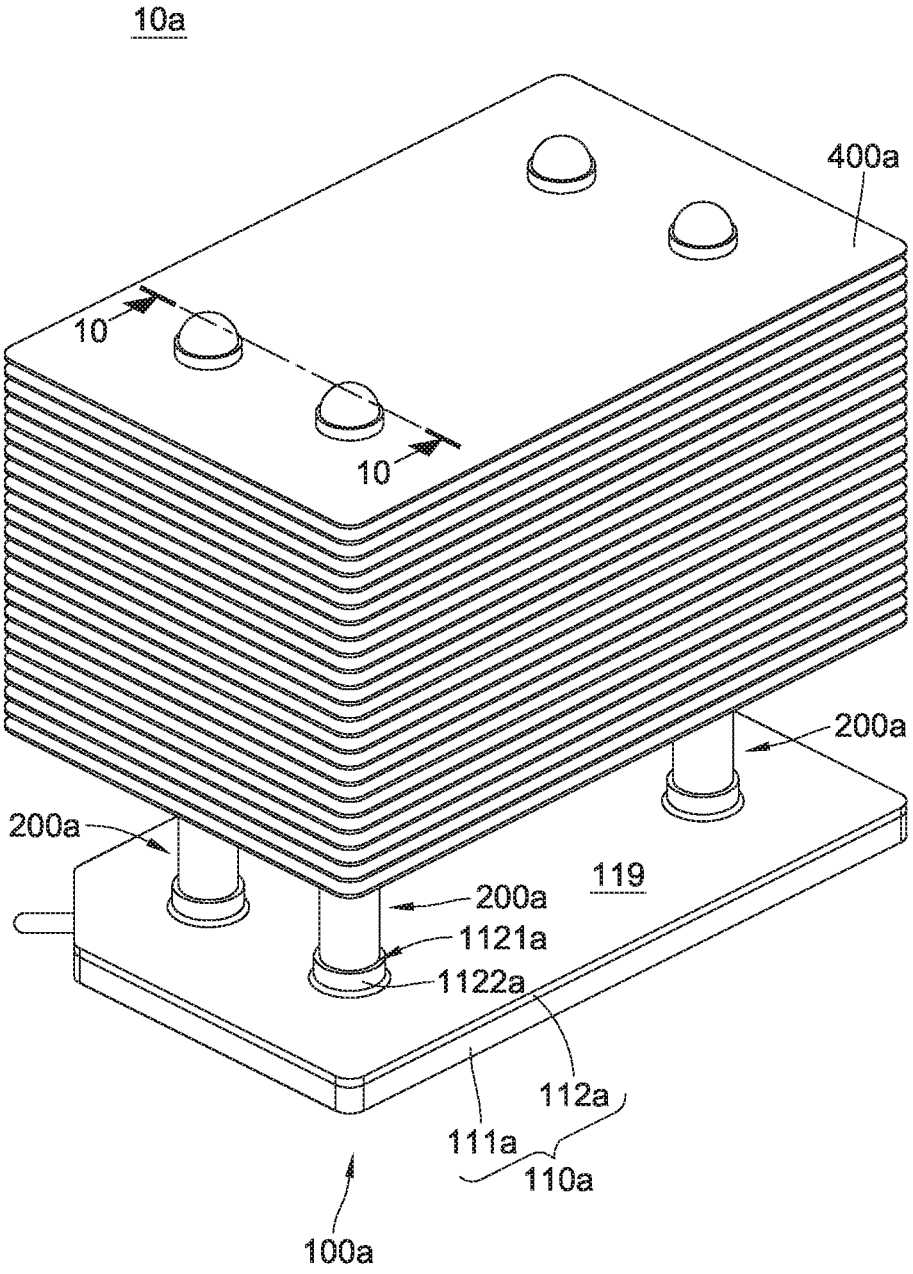
FIG. 8 is a perspective view of a heat transfer device according to the example embodiments.
Figure 9:
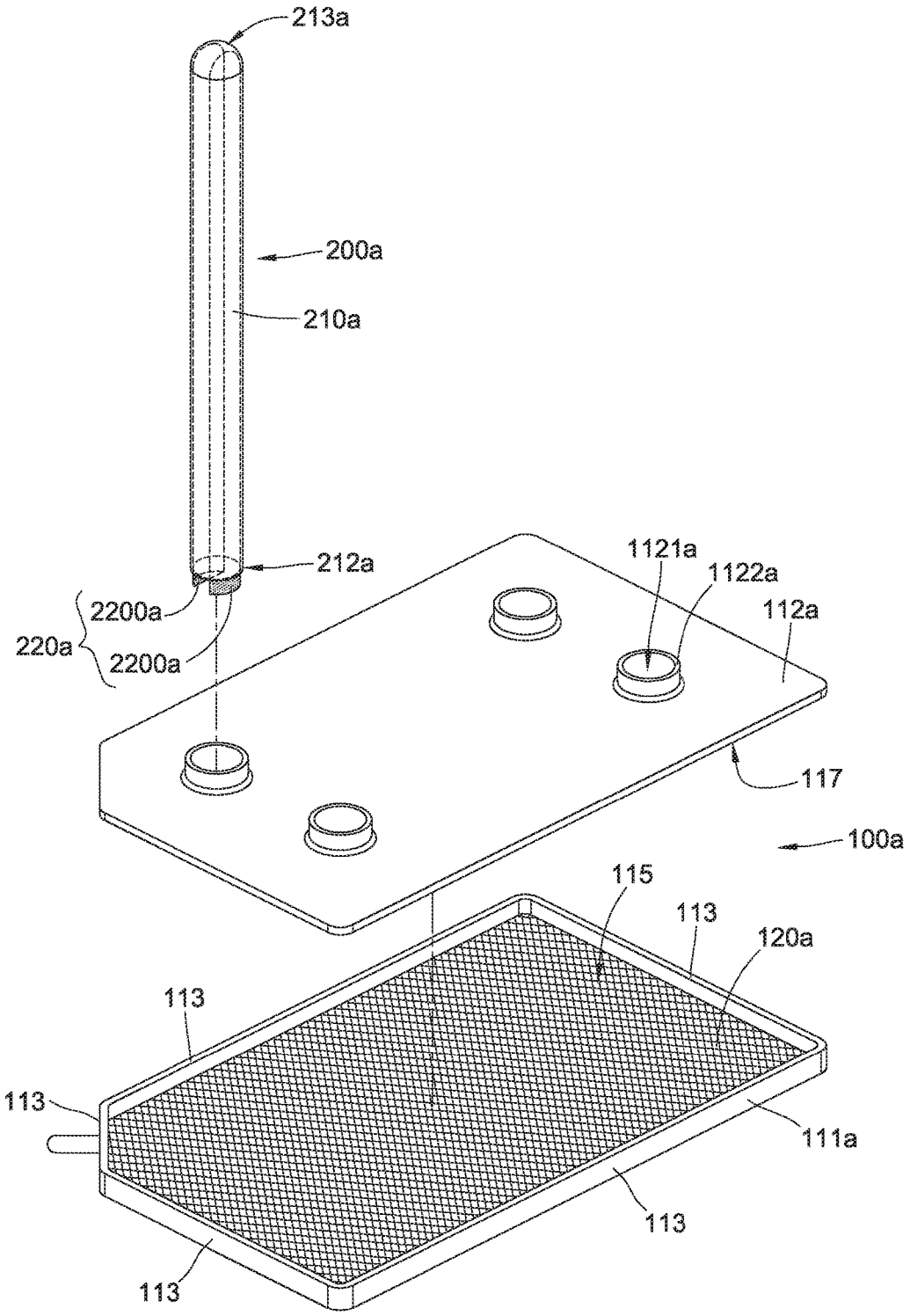
FIG. 9 is an exploded view of the heat transfer device in FIG. 8 illustrating some of the components of the heat transfer device.
Figure 10:
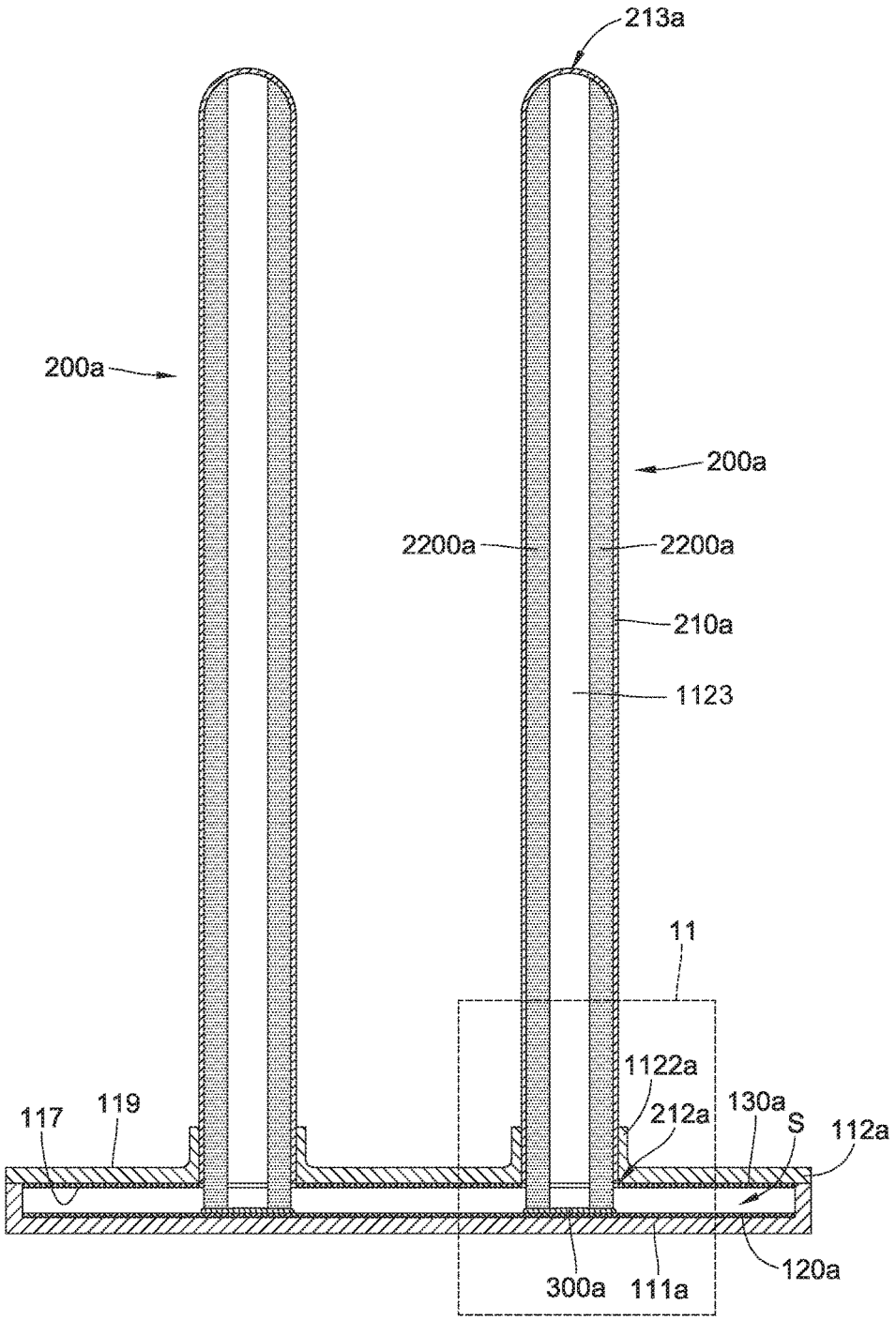
FIG. 10 is a cross-sectional view of the heat transfer device in FIG. 8.
Figure 11:
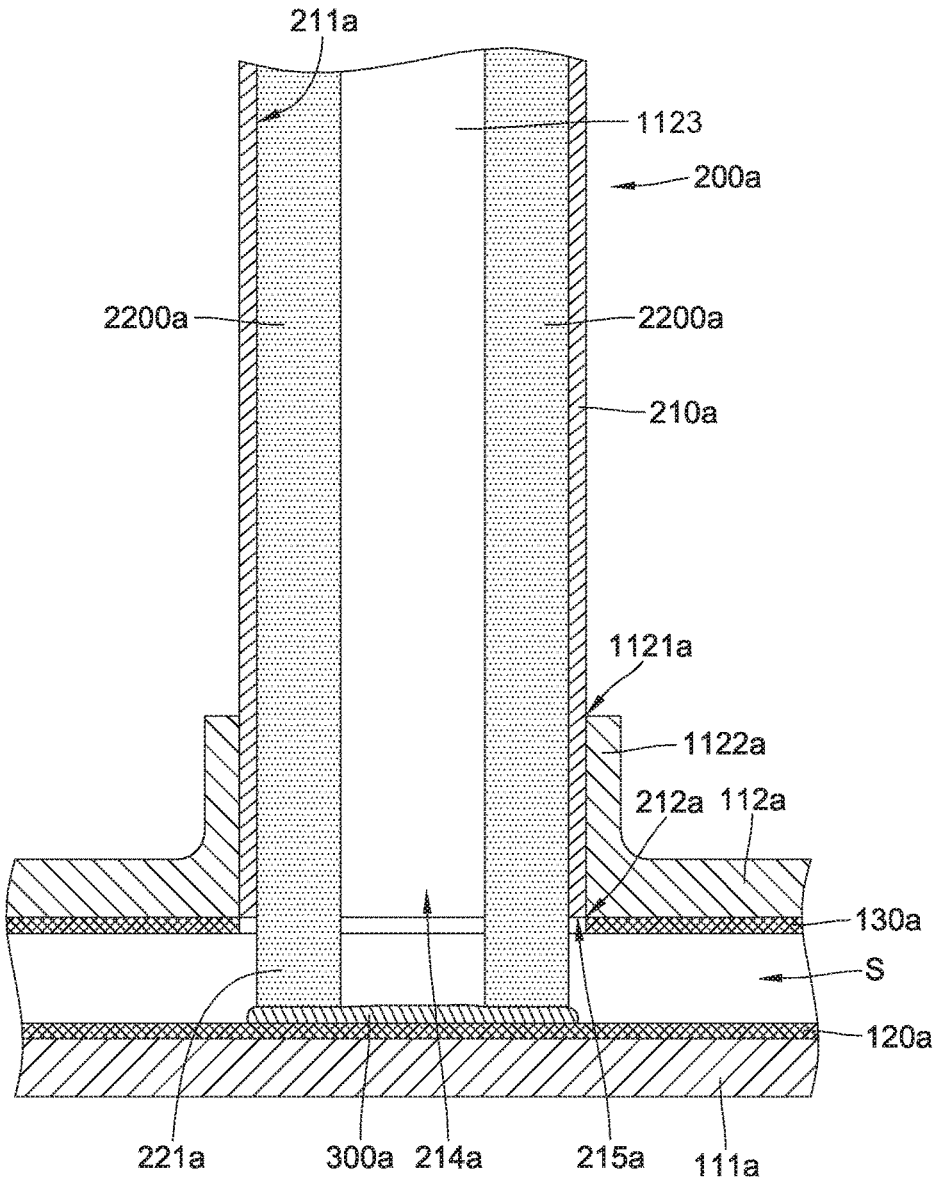
FIG. 11 is an enlarged view of a portion of the heat transfer device in FIG. 10.
Figure 12:
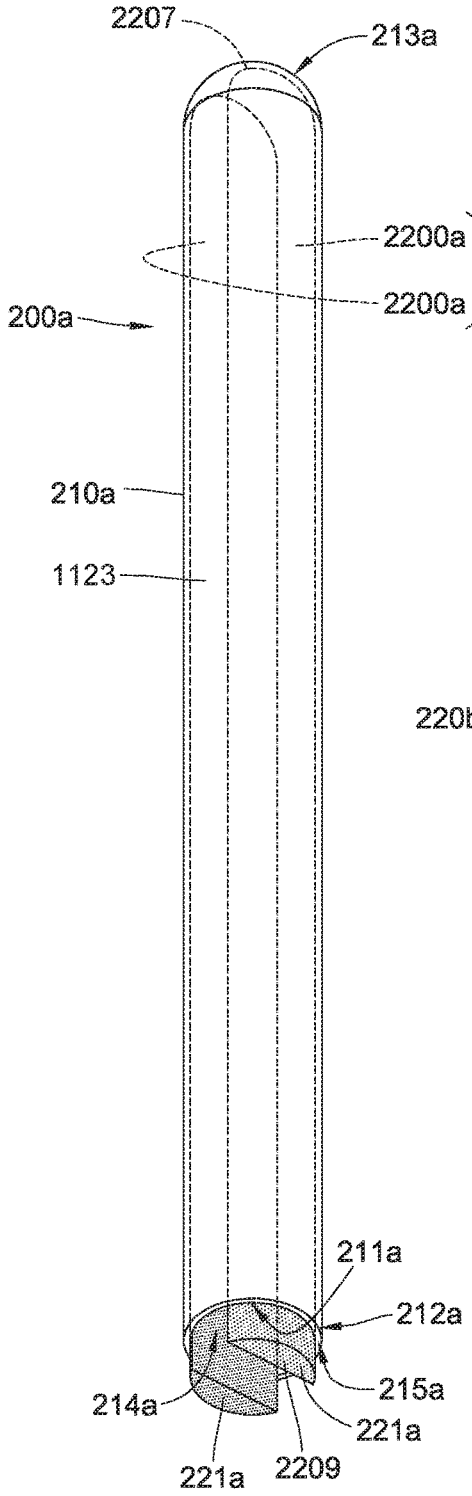
FIG. 12 is a perspective view of a heat pipe in FIG. 9.

FIG. 8 is a perspective view of a heat transfer device 10*a*, according to the example embodiments. FIG. 9 is an exploded view of the heat transfer device 10*a* in FIG. 8 illustrating some of the components of the heat transfer device 10*a*. FIG. 10 is a cross-sectional view of the heat transfer device 10*a* in FIG. 8. FIG. 11 is an enlarged view of a portion of the heat transfer device 10*a* in FIG. 10. FIG. 12 is a perspective view of a heat pipe 200*a* in FIG. 9.

Referring to FIGS. 8-12, the three-dimensional (3D) heat transfer device 10*a* includes a vapor chamber 100*a*, multiple heat pipes 200*a*, and a fin assembly 400*a* including a plurality of fins. The vapor chamber 100*a* and the heat pipes 200*a* are configured to allow working fluid (e.g., vapor, in this case, but can be any liquid or gas) to flow in the vapor chamber 100*a* and the heat pipes 200*a*.

The vapor chamber 100*a* includes a chamber body 110*a* and a first capillary structure 120*a*. The chamber body 110*a* includes a first (or bottom) plate 111*a* and a second (or top) plate 112*a*. The first plate 111*a* includes a bottom part 115 and sidewalls 113 arranged along the periphery of the bottom part 115. The bottom part 115 and the sidewalls 113 thus define the general shape of the first plate 111*a*. The bottom part 115 is a generally planar structure and the sidewalls 113 are generally vertical structures arranged along the periphery of the bottom part 115. The second plate 112*a* is connected to the sidewalls 113 of the first plate 111*a* along the periphery thereof (e.g., along the edges of the second plate 112*a*), and the first plate 111*a* and the second plate 112*a* jointly define a cavity S. The cavity S is configured to accommodate the working fluid. In an example, and as illustrated, the first plate 111*a* and the second plate 112*a* are shown as separate components that are assembled together to form the chamber body 110*a*, but embodiments are not limited in this regard. In some other embodiments, the chamber body 110*a* is a unitary structure wherein the first plate 111*a* is integrally formed with the second plate 112*a*.

The first capillary structure 120*a* is disposed in the cavity S and on the bottom part 115 of the first plate 111*a*. In an embodiment, and as illustrated, the first capillary structure 120*a* is disposed on the entire bottom part 115; however, in other embodiments, the first capillary structure 120*a* may be disposed in a portion of the bottom part 115. The vapor chamber 100*a* further includes a third capillary structure 130*a* disposed in the cavity S and on a bottom surface 117 of the second plate 112*a* facing the first plate 111*a*. However, in other embodiments of the vapor chamber, the third capillary structure 130*a* is omitted, and the vapor chamber includes only the first capillary structure 120*a*. In an embodiment, the first capillary structure 120*a* and the third capillary structure 130*a* are selected from the group consisting of metal mesh, sintered metal powder, sintered ceramic, micro grooves, and combination thereof.

The second plate 112*a* includes multiple through holes 1121*a*, each including a flange 1122*a* along the edges of the through holes 1121*a* and that projects vertically upward from a top surface 119 of the second plate 112*a* opposite the bottom surface 117. The through holes 1121*a* are arranged in a pattern on the second plate 112*a*; however, the arrangement of the through holes 1121*a* is not limited in this regard. The number of the through holes 1121*a* is equal to the number of the heat pipes 200*a*. For example, when the 3D heat transfer device 10*a* includes single heat pipe 200*a*, the second plate 112*a* includes a single through hole 1121*a*. Each flange 1122*a* is connected to the edge of the corresponding through hole 1121*a* and is shaped and sized, or otherwise configured, for receiving a heat pipe 200*a* therewithin.

Referring to FIGS. 10-12, each of the heat pipes 200*a* includes a pipe body 210*a* and a second capillary structure 220*a* disposed along the inner circumferential surface 211*a* of the pipe body 210*a*. In an embodiment, and as illustrated, the pipe body 210*a* is a generally cylindrical hollow tube. Each pipe body 210*a* includes an open end 212*a* and a closed end 213*a* opposite the open end 212*a*. The open end 212*a* of the pipe body 210*a* includes an opening 214*a* (FIGS. 11 and 12) of the pipe body 210*a* and an edge 215*a* of the pipe body 210*a* that defines the opening 214*a*. The second capillary structure 220*a* includes two capillary elements 2200*a* disposed on and lining the inner circumferential surface 211*a*. The two capillary elements 2200*a* are arranged circumferentially and radially spaced apart (e.g., non-contacting) from each other to define a vapor passage 1123. Each capillary element 2200*a* includes a curved or arched surface that contacts the inner circumferential surface 211*a* and a planar surface that faces the interior of the pipe body 210*a* and defines the vapor passage 1123. An axial end 2207 of each capillary element 2200*a* contacts the interior of the pipe body 210*a* at the closed end 213*a*, and the opposite axial end 2209 of each capillary element 2200*a* includes a contact portion 221*a* extending axially out of the pipe body 210*a* a certain distance from the edge 215*a* of the pipe body 210*a*. The contact portion 221*a* thus forms an exposed portion of the capillary element 2200*a*. In an embodiment, the second capillary structure 220*a* is a sintered solid part including metal powder, but embodiments are not limited in this regard. In some other embodiments, the second capillary structure is selected from the group consisting of metal mesh, sintered metal powder, sintered ceramic, micro grooves, and combination thereof.

Each heat pipe 200*a* is inserted in the through hole 1121*a*, and each capillary element 2200*a* of the second capillary structure 220*a* is connected to the first capillary structure 120*a* by metallic bonding. Referring to FIGS. 10 and 11, the 3D heat transfer device 10*a* further includes a bonding layer 300*a* including gold powder, silver powder, copper powder, iron powder, a combination thereof, and the like. The powder(s) is/are sintered to form the bonding layer 300*a* including a porous structure. One surface of the bonding layer 300*a* is connected to the first capillary structure 120*a* by metallic bonding, and the other opposite surface of the bonding layer 300*a* is connected to the second capillary structure 220*a* by metallic bonding.

In conventional heat transfer devices, metal bonding layer is not included between capillary structures, and the capillary structures directly contact each other. The bonding layer 300*a*, according to example embodiments, provides a metallic bonding between the first capillary structure 120*a* and the second capillary structure 220*a* and improves the flow rate of the working fluid between the second capillary structure 220*a* and the first capillary structure 120*a*, thereby increasing a heat dissipation efficiency of the 3D heat transfer device 10*a*.

A method of manufacturing the 3D heat transfer device 10*a* includes providing a vapor chamber 100*a* including a first capillary structure 120*a*. At least part of the first capillary structure 120*a* includes a metal powder. The method then includes contacting a second capillary structure 220*a* of a heat pipe 200*a* with the first capillary structure 120*a*. A sintering process is then performed to sinter the metal powder to form the bonding layer 300*a*. The bonding layer 300*a* is connected to the first capillary structure 120*a* and the second capillary structure 220*a* by metallic bonding.

According to example embodiments, the 3D heat transfer device 10*a* includes multiple (four, in this case) heat pipes 200*a*, but embodiments are not limited thereto. In some other embodiments, the 3D heat transfer device 10*a* includes a single heat pipe 200*a* or more than four heat pipes 200*a*. The multiple heat pipes 200*a*, and the corresponding through holes 1121*a*, can be arranged in any desired manner on the vapor chamber 100*a*.

According to example embodiments, the second capillary structure 220*a* of the heat pipe 200*a* is connected to the first capillary structure 120*a* by metallic bonding, while metallic bonding is absent between the first capillary structure 120*a* and the third capillary structure 130*a*. However, embodiments are not limited in this regard. In other embodiments, the second capillary structure 220*a* is connected to both the first capillary structure 120*a* and the third capillary structure 130*a* by metallic bonding.

Referring to FIG. 8, the fin assembly 400*a* including a plurality of fins disposed on the heat pipes 200*a* improves the heat dissipation efficiency of the 3D heat transfer device 10*a*. Herein, the heat generated by a heat source is transferred through the heat pipes 200*a* to the fin assembly 400*a*, thereby increasing the surface area for heat dissipation and providing increased heat dissipation in a relatively smaller area.

FIGS. 13-19 illustrate different embodiments of heat pipes 200*b*-200*h*, each of which may be used in place of the heat pipe 200*a*.

Figure 13:
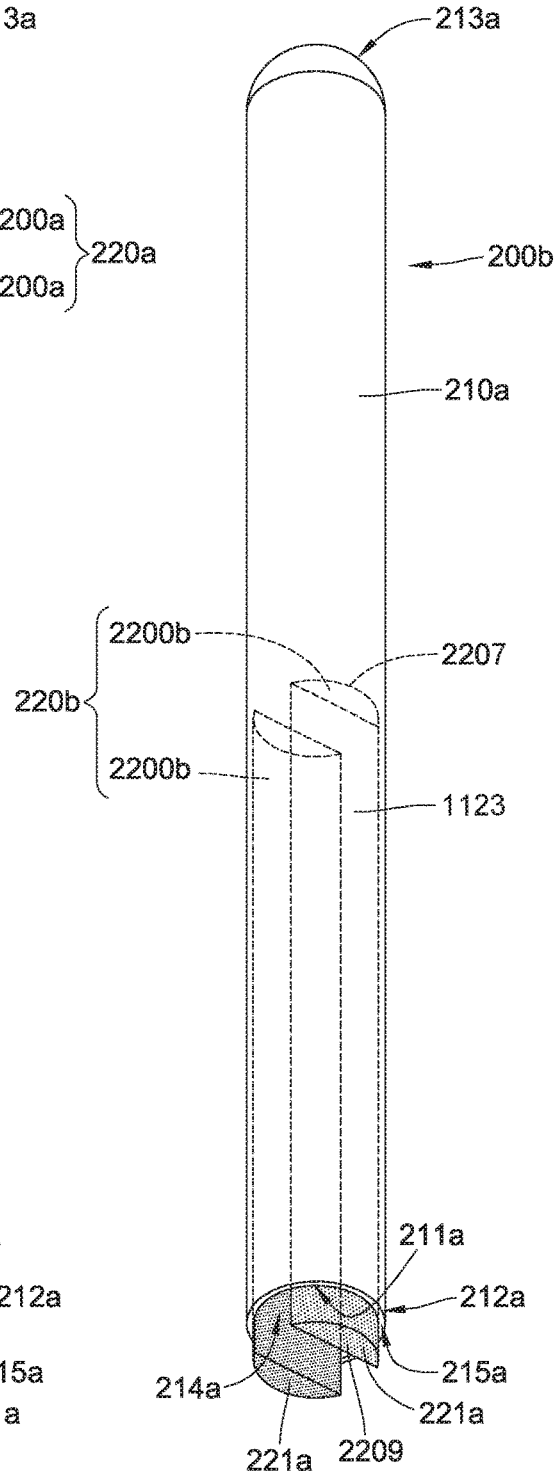
FIG. 13 is a perspective view of a heat pipe, according to example embodiments.

FIG. 13 is a perspective view of a heat pipe 200*b* according to example embodiments. The heat pipe 200*b* may be similar in some respects to the heat pipe 200*a* in FIG. 12, and therefore may be best understood with reference thereto where like numerals designate like components not described again in detail. As illustrated, the heat pipe 200*b* includes a second capillary structure 220*b* disposed on and lining the inner circumferential surface 211*a* of the pipe body 210*a*. The second capillary structure 220*b* includes two capillary elements 2200*b* similar to the capillary elements 2200*a*. Each capillary element 2200*b* is disposed on and lines (contacts) the inner circumferential surface 211*a*, and is circumferentially spaced apart from the other capillary element 2200*b*. An axial end 2207 of each capillary element 2200*b* inside the pipe body 210*a* is axially spaced from the closed end 213*b*, and the other opposite axial end 2209 of each capillary element 2200*b* includes a contact portion 221*a* extending axially out of the pipe body 210*a* a certain distance from the edge 215*a* of the pipe body 210*a* and thereby exposed. In an embodiment, the length (e.g., axial extent) of each capillary element 2200*b* is about half of the length (e.g., axial extent) of the pipe body 210*a*, and the axial end 2207 is located below the mid-point of the heat pipe 200*b*. However, embodiments are not limited in this regard. In an embodiment, the length of each capillary element 2200*b* is greater than half the length of the pipe body 210*a*, but the capillary element 2200*b* does not contact the closed end 213*a*. In another embodiment, the length of each capillary element 2200*b* is less than half the length of the pipe body 210*a*. In yet another embodiment, the two capillary elements 2200*b* may have different lengths.

Figure 14:
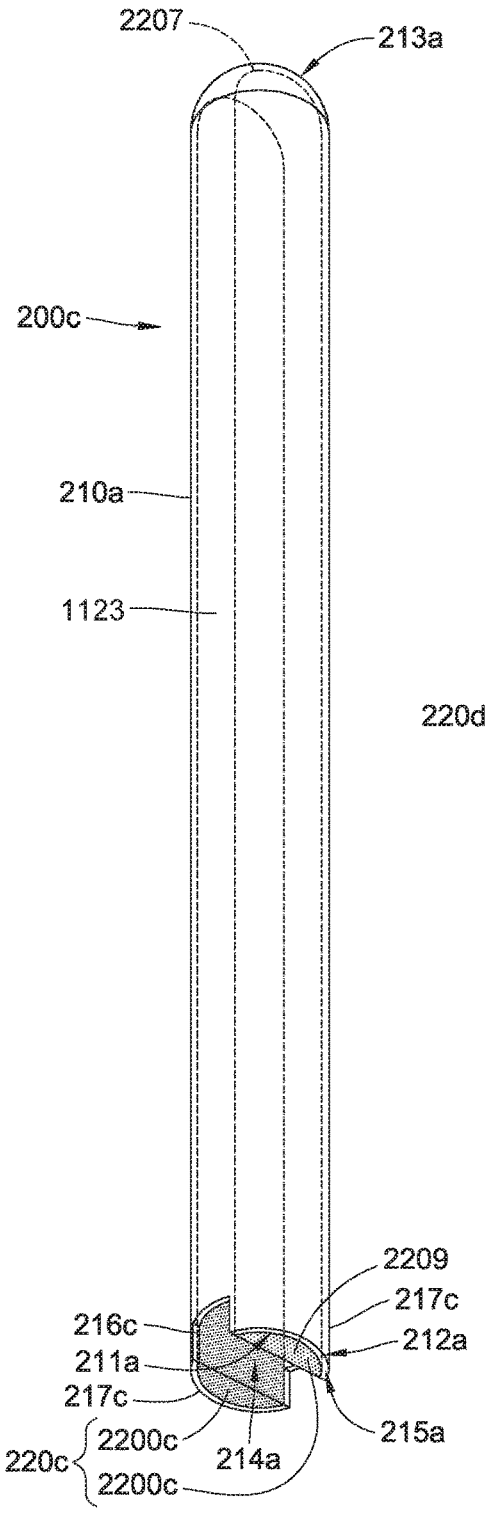
FIG. 14 is a perspective view of a heat pipe, according to example embodiments.

FIG. 14 is a perspective view of a heat pipe 200*c* according to example embodiments. The heat pipe 200*c* may be similar in some respects to the heat pipe 200*a* in FIG. 12, and therefore may be best understood with reference thereto where like numerals designate like components not described again in detail. As shown in FIG. 14, the heat pipe 200*c* includes a second capillary structure 220*c* disposed on and lining the inner circumferential surface 211*a* of the pipe body 210*a*. The second capillary structure 220*c* includes two capillary elements 2200*c* similar to the capillary elements 2200*a*. Each capillary element 2200*c* is disposed on and lines the inner circumferential surface 211*a*, and is circumferentially and radially spaced apart from the other capillary element 2200*c*. The axial end 2207 of each capillary element 2200*c* inside the pipe body 210*a* contacts the interior of the pipe body 210*a* at the closed end 213*a*, and the other opposite end 2209 of each capillary element 2200*c* is flush with the edge 215*a*. In an embodiment, the length (e.g., axial extent) of the capillary element 2200*c* is substantially equal to the length (e.g., axial extent) of the pipe body 210*a* including projections 217*c* (see below). However, in other embodiments, the capillary elements 2200*c* may have different lengths, wherein the end 2207 of a capillary element 2200*c* is axially spaced from the pipe body 210*a* at the closed end 213*a*.

At the open end 212*a*, the pipe body 210*a* includes recesses 216*c* (two shown) extending axially from the edge 215*a*, and projections 217*c* (two shown) formed by the recesses 216*c* at the open end 212*a*. As illustrated, each capillary element 2200*c* extends from the closed end 213*a* to the edge 215*a* included in a projection 217*c* and flush with the edge 215*a*. In an embodiment, and as illustrated, the capillary elements 2200*c* do not extend into the recesses 216*c*. The recesses 216*c* are in fluid communication with the opening 214*a* and thereby with the vapor passage 1123. Each recess 216*c* is shaped and sized, or otherwise configured, to provide a fluid path through which working fluid, such as vapor, flows.

Figure 15:
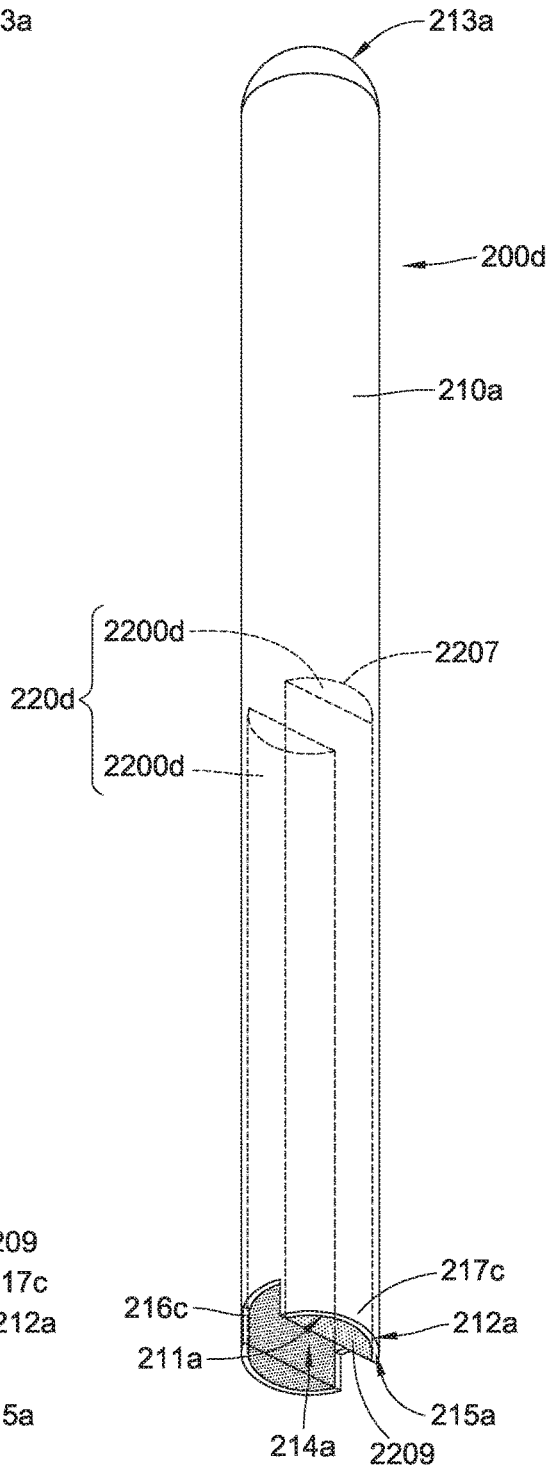
FIG. 15 is a perspective view of a heat pipe, according to example embodiments.

FIG. 15 is a perspective view of a heat pipe 200*d* according to example embodiments. The heat pipe 200*d* may be similar in some respects to the heat pipe 200*c* in FIG. 14, and therefore may be best understood with reference thereto where like numerals designate like components not described again in detail. As illustrated in FIG. 15, the heat pipe 200*d* includes a second capillary structure 220*d* disposed on and lining the inner circumferential surface 211*a*. The second capillary structure 220*d* includes two capillary elements 2200*d* disposed on and lining the inner circumferential surface 211*a*, and spaced apart from each other. The end 2207 of each capillary element 2200*d* inside the pipe body 210*a* is axially spaced from the closed end 213*d*, and the opposite axial end 2209 of the capillary element 2200*d* is flush with the edge 215*a*. In an embodiment, the length (e.g., axial extent) of each capillary element 2200*d* is about half of the length (e.g., axial extent) of the pipe body 210*a*. However, embodiments are not limited in this regard. In an embodiment, the length of each capillary element 2200*d* is greater than half the length of the pipe body 210*a*, but the capillary element 2200*d* does not contact the closed end 213*a*. In another embodiment, the length of each capillary element 2200*d* is less than half the length of the pipe body 210*a*. In yet another embodiment, the capillary elements 2200*d* may have different lengths.

Figure 16:
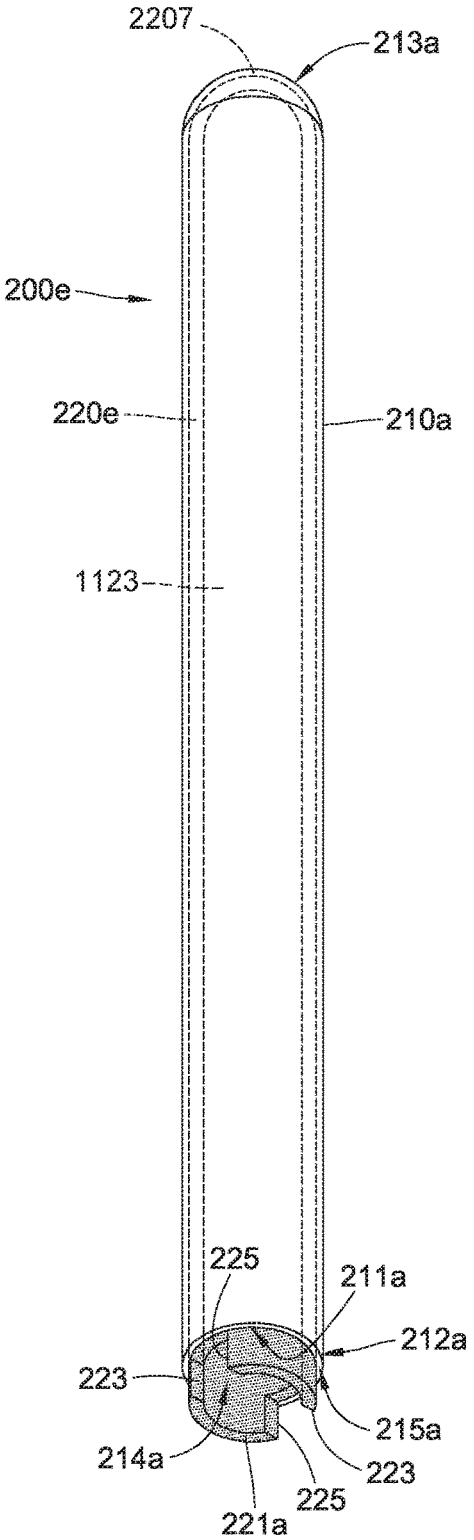
FIG. 16 is a perspective view of a heat pipe, according to example embodiments.

FIG. 16 is a perspective view of a heat pipe 200*e* according to example embodiments. The heat pipe 200*e* may be similar in some respects to the heat pipe 200*a* in FIG. 12, and therefore may be best understood with reference thereto where like numerals designate like components not described again in detail. As illustrated in FIG. 16, the heat pipe 200*e* includes a second capillary structure 220*e* disposed on and lining the inner circumferential surface 211*a*.

As illustrated, the second capillary structure 220*e* lines the entire inner circumferential surface 211*a*. The second capillary structure 220*e* is a generally tubular structure having an outer circumferential surface contacting the inner circumferential surface 211*a* and an inner circumferential surface that defines the vapor passage 1123 that extends the axial length of the second capillary structure 220*e*. One end of the second capillary structure 220*e* contacts the interior surface of the pipe body 210*a* at the closed end 213*e*, and the other opposite end of the second capillary structure 220*e* includes contact portion 221*a* extending axially out of the pipe body 210*a* a certain distance from the edge 215*a* of the pipe body 210*a*, and is thereby exposed. Specifically, the length of the second capillary structure 220*e* is substantially equal to the length of the pipe body 210*e*. In an embodiment, the contact portion 221*a* includes two (or more) projections 223 circumferentially separated from each other by recesses 225 (two shown) defined in the second capillary structure 220*e*. Each recess 225 may extend axially from an axial end of the second capillary structure 220*e* in the contact portion 221*a*, and a bottom of each recess 225 is flush with the edge 215*a* of the pipe body 210*a*.

Figure 17:
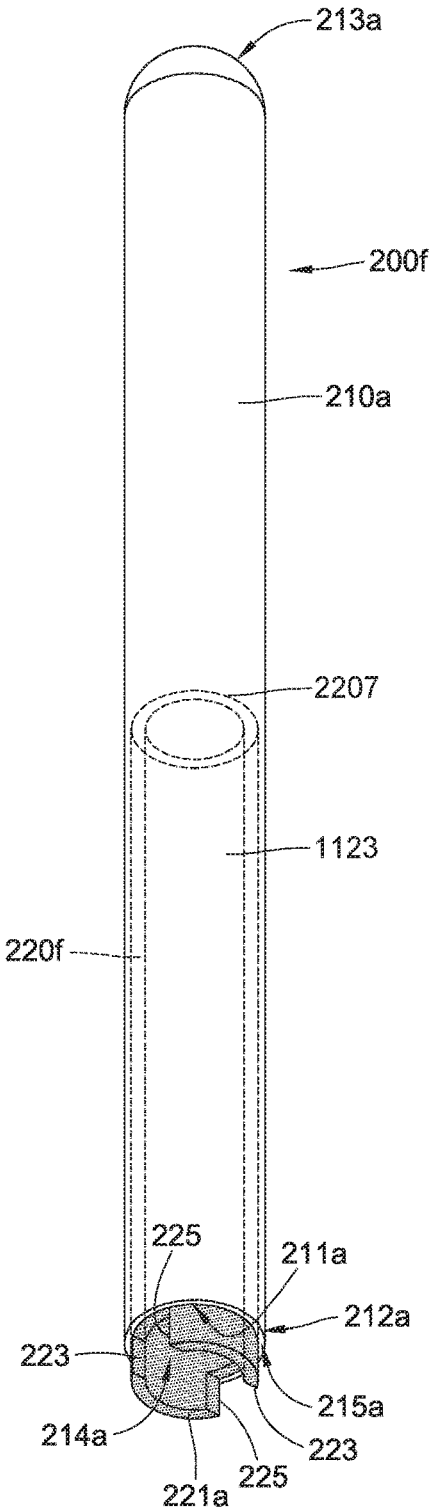
FIG. 17 is a perspective view of a heat pipe, according to example embodiments.

FIG. 17 is a perspective view of a heat pipe 200*f* according to example embodiments. The heat pipe 200*f* may be similar in some respects to the heat pipe 200*e* in FIG. 16, and therefore may be best understood with reference thereto where like numerals designate like components not described again in detail. As illustrated in FIG. 17, the heat pipe 200*f* includes a second capillary structure 220*f* disposed on and lining an inner circumferential surface 211*a*. The second capillary structure 220*f* is similar to the second capillary structure 220*e* in FIG. 16, except that the axial end 2207 of the second capillary structure 220*f* inside the pipe body 210*a* is axially spaced from the closed end 213*a*. In an embodiment, the length (e.g., axial extent) of the second capillary structure 220*f* is about half of the length of the pipe body 210*a*. However, embodiments are not limited in this regard. In an embodiment, the length of the second capillary structure 220*f* is greater than half the length of the pipe body 210*a*, but the second capillary structure 220*f* does not contact the closed end 213*a*. In another embodiment, the length of the second capillary structure 220*f* is less than half the length of the pipe body 210*a*.

Figure 18:
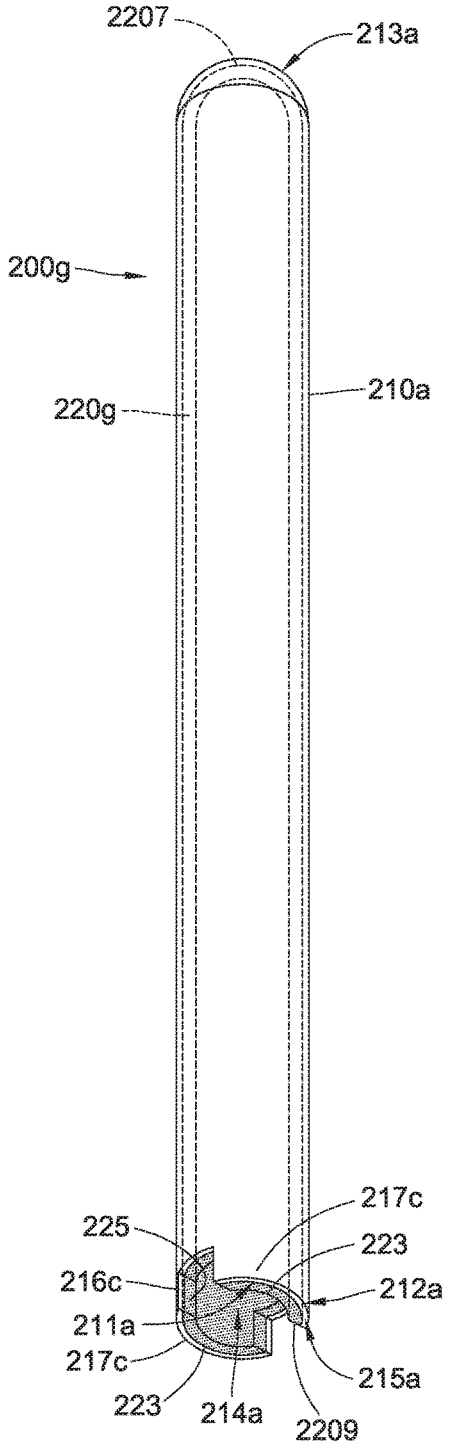
FIG. 18 is a perspective view of a heat pipe, according to example embodiments.

FIG. 18 is a perspective view of a heat pipe 200*g* according to example embodiments. The heat pipe 200*g* may be similar in some respects to the heat pipes 200*c* and 200*e* in FIGS. 14 and 16, respectively, and therefore may be best understood with reference thereto where like numerals designate like components not described again in detail. As illustrated in FIG. 18, the heat pipe 200*g* includes a second capillary structure 220*g* disposed on and lining the entire inner circumferential surface 211*a* of the pipe body 210*a*. The open end 212*a* of the pipe body 210*a* includes recesses 216*c* and two projections 217*c* similar to the heat pipe 200*c* in FIG. 14 The second capillary structure 220*g* includes two projections 223 circumferentially separated from each other by recesses 225 defined in the second capillary structure 220*g* at the open end 212*a* The second capillary structure 220*g* is flush with the pipe body 210*a* in the recesses 216*c*. The projections 223 of the second capillary structure 220*g* also line the inner circumferential surface 211*a* of the pipe body 210*a* in the projections 217*c*. The number of projections 223 correspond to the number of projections 217*c*. The projections 223 of the second capillary structure 220*g* are flush with the projections 217*c* of the pipe body 210*a*.

Figure 19:
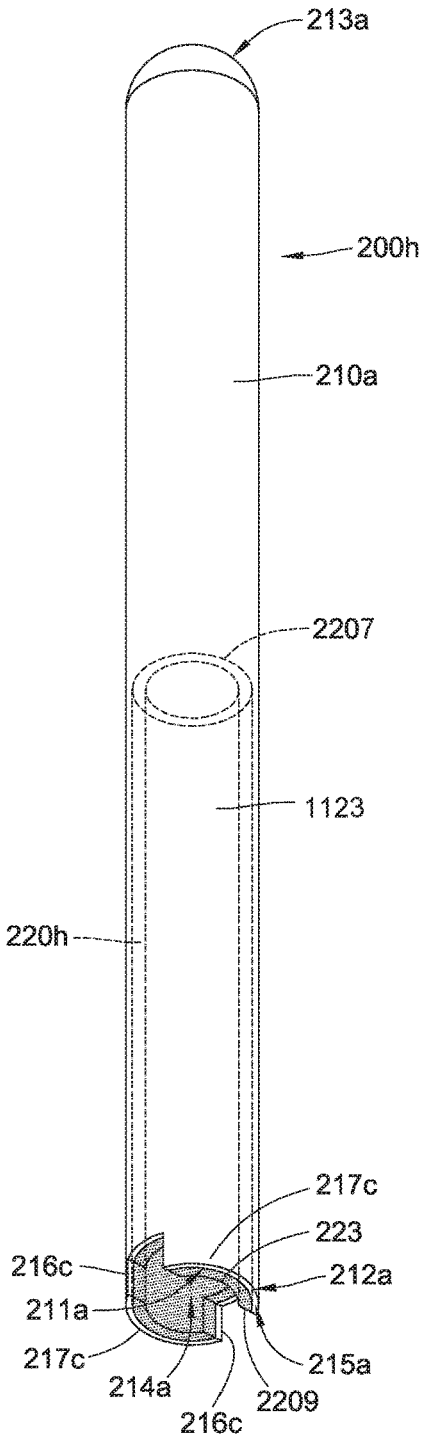
FIG. 19 is a perspective view of a heat pipe, according to example embodiments.

FIG. 19 is a perspective view of a heat pipe 200*h* according to example embodiments. The heat pipe 200*h* may be similar in some respects to the heat pipe 200*g* in FIG. 18, and therefore may be best understood with reference thereto where like numerals designate like components not described again in detail. As illustrated in FIG. 19, the heat pipe 200*h* includes a second capillary structure 220*h* disposed on and lining an inner circumferential surface 211*a*. The second capillary structure 220*h* is similar to the second capillary structure 220*g* in FIG. 18, except that the axial end 2207 of the second capillary structure 220*h* inside the pipe body 210*a* is axially spaced from the closed end 213*a*. In an embodiment, the length (e.g., axial extent) of the second capillary structure 220*h* is about half of the length of the pipe body 210*a*. However, embodiments are not limited in this regard. In an embodiment, the length of the second capillary structure 220*h* is greater than half the length of the pipe body 210*a*, but the second capillary structure 220*h* does not contact the closed end 213*a*. In another embodiment, the length of the second capillary structure 220*h* is less than half the length of the pipe body 210*a*.

Figure 20:
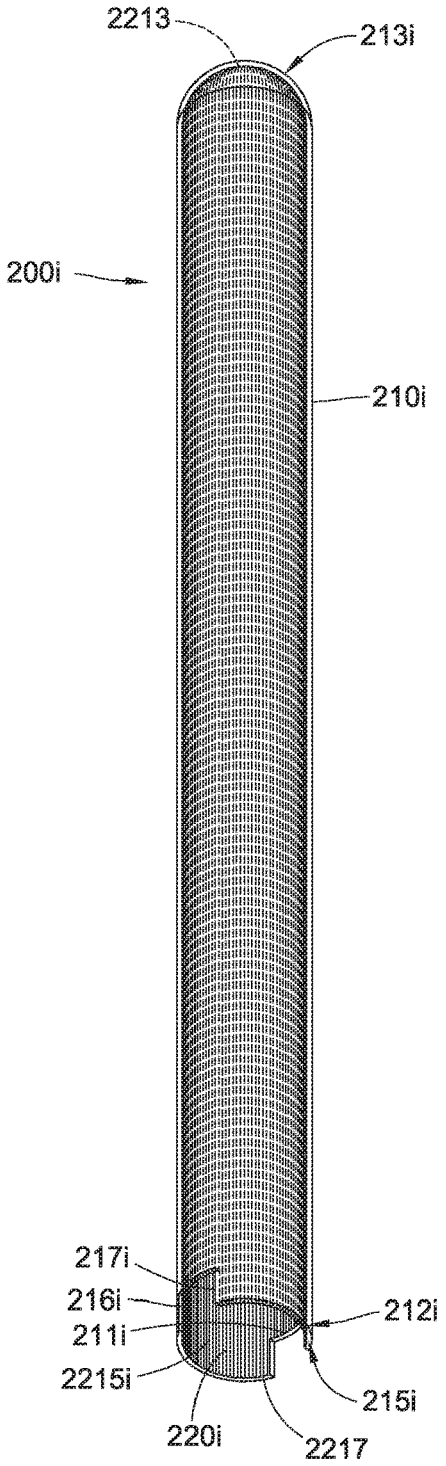
FIG. 20 is a perspective view of a heat pipe, according to example embodiments.

FIG. 20 is a perspective view of a heat pipe 200*i* according to the example embodiments. As illustrated in FIG. 20, the heat pipe 200*i* includes a pipe body 210*i* and a second capillary structure 220*i*. The pipe body 210*i* is a generally cylindrical hollow tube that includes an open end 212*i* and an axially opposite closed end 213*i*. The open end 212*i* of the pipe body 210*i* includes an edge 215*i*. The second capillary structure 220*i* is disposed on and lines an entire inner circumferential surface 211*i* of the pipe body 210*i* and defines the vapor passage 1123. In an embodiment, the second capillary structure 220*i* includes multiple micro grooves 2215*i*. The micro grooves 2215*i* extend axially along the inner circumferential surface 211*i* between the closed end 213*i* and open end 212*i*. An axial end 2213 of each micro groove 2215*i* contacts the interior surface of the pipe body 210*i* at the closed end 213*i*, and the other axially opposite end 2217 of each micro groove 2215*i* is flush with the edge 215*i*. In an embodiment, the micro grooves 2215*i* extend an entire axial length of the pipe body 210*i*. The pipe body 210*i* includes multiple (two shown) recesses 216*i* extending axially from the edge 215*i*. The recesses 216*i* define projections 217*i* at the open end 212*i*. It will thus be understood that, the micro grooves 2215*i* that end in the recesses 216*i* have a smaller length that the micro grooves 2215*i* that end at the edges 215*i*.

Figure 21:
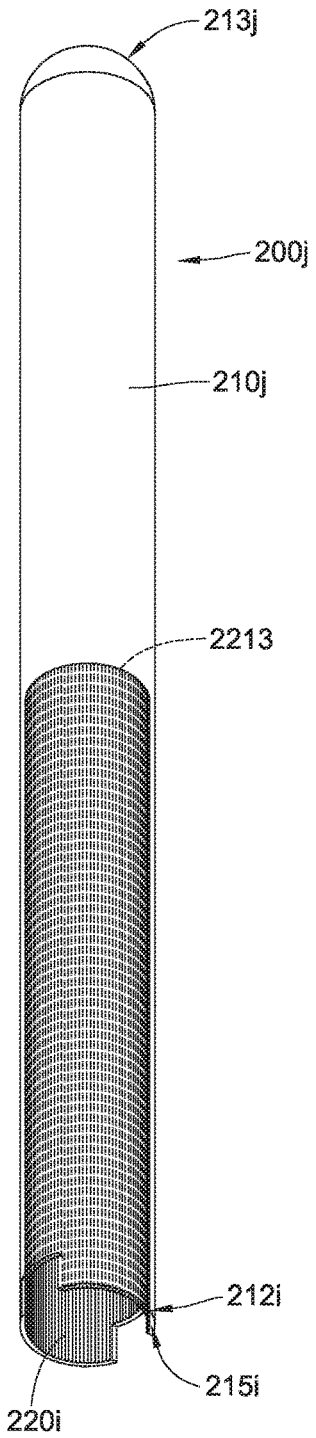
FIG. 21 is a perspective view of a heat pipe, according to example embodiments.

FIG. 21 is a perspective view of a heat pipe 200*j* according to example embodiments. The heat pipe 200*j* may be similar in some respects to the heat pipe 200*i* in FIG. 20, and therefore may be best understood with reference thereto where like numerals designate like components not described again in detail. As illustrated, the end 2213 of each micro groove 2215*i* is axially spaced from the closed end 213*j*, and the axially opposite end 2217 of the micro grooves 2215*i* is flush with the edge 215*j* or with the recess 216*i*. In an embodiment, the length of the micro groove 2215*i* extending along the inner circumferential surface 211*i* and along the projections 217*i* is about half of the length of the pipe body 210*j*.

Figure 22:
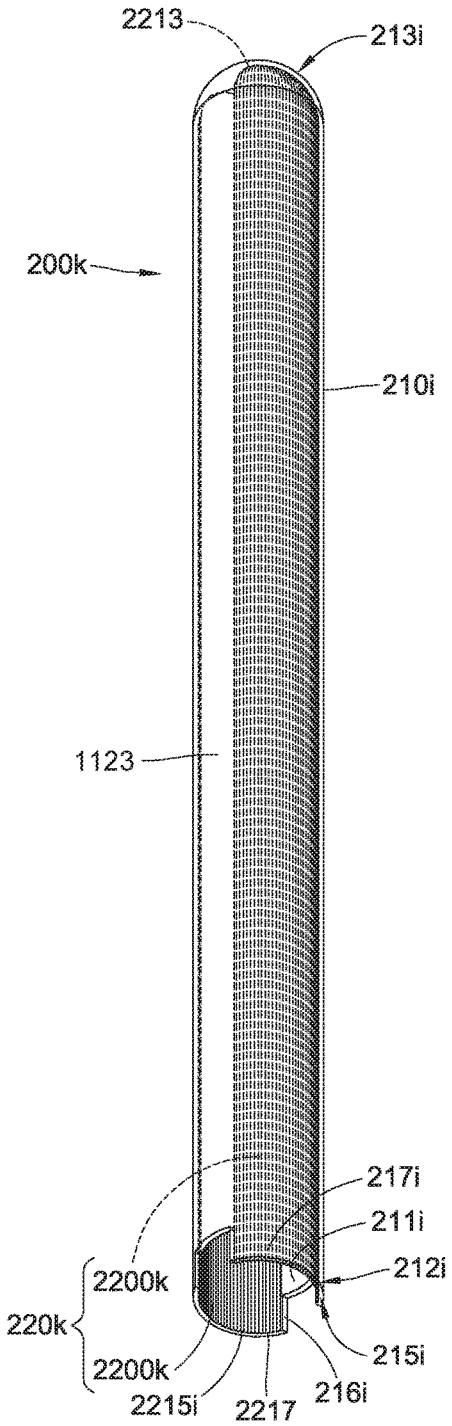
FIG. 22 is a perspective view of a heat pipe, according to example embodiments.

FIG. 22 is a perspective view of a heat pipe 200*k* according to example embodiments. The heat pipe 200*k* may be similar in some respects to the heat pipe 200*i* in FIG. 20, and therefore may be best understood with reference thereto where like numerals designate like components not described again in detail. As illustrated in FIG. 22, the heat pipe 200*k* includes a second capillary structure 220*k* similar to the second capillary structure 220*i*, except that the second capillary structure 220*k* includes two capillary elements 2200*k* disposed on and lining the inner circumferential surface 211*i* of the pipe body 210*k*. The two capillary elements 2200*k* are circumferentially and radially spaced apart from each other, and define vapor passage 1123 therebetween. Each capillary element 2200*k* includes a plurality of micro grooves 2215*i*. An end 2213 of the micro grooves 2215*i* contacts the interior surface of the heat pipe 200*k* at the closed end 213*k*, and the micro grooves 2215*i* extend on the projections 217*i* and the axially opposite end of the micro grooves 2215*i* is flush with the edge 215*i* of the pipe body 210*i* in the projections 217*i*. In an embodiment, the length of each micro groove 2215*i* is substantially equal to the length of the pipe body 210*i* including the projections 217*i*. As illustrated, the micro grooves 2215*i* are absent in the axial portion of the pipe body 210*i* between the recess 216*i* and the closed end 213*i*.

Figure 23:
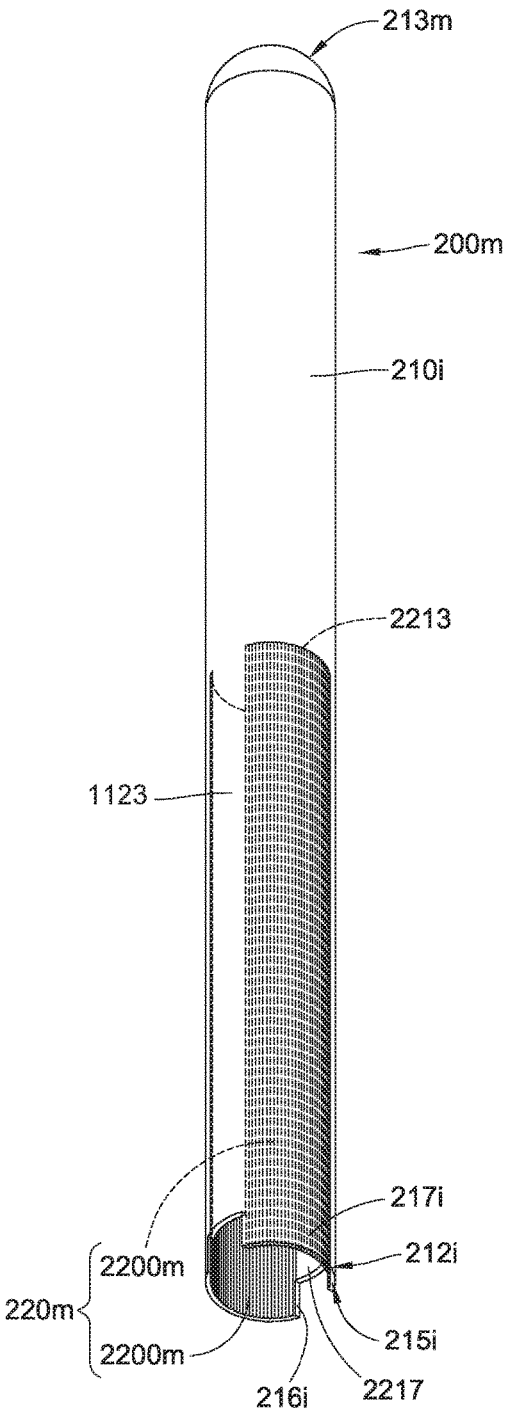
FIG. 23 is a perspective view of a heat pipe, according to example embodiments.

FIG. 23 is a perspective view of a heat pipe 200*m* according to example embodiments. The heat pipe 200*m* may be similar in some respects to the heat pipe 200*j* in FIG. 21, and therefore may be best understood with reference thereto where like numerals designate like components not described again in detail. As illustrated, the heat pipe 200*m* includes a second capillary structure 220*m* similar to the second capillary structure 220*i* in FIG. 21, except that the second capillary structure 220*m* includes two capillary elements 2200*m* disposed on and lining the inner circumferential surface 211*i* of the pipe body 210*m*. The two capillary elements 2200*m* are circumferentially and radially spaced apart from each other. Each capillary element 2200*m* includes multiple micro grooves 2215*i*. An end 2213 of each micro groove 2215*i* is axially spaced from the closed end 213*i*, and the other axially opposite end 2217 of each micro groove 2215*i* is flush with the edge 215*i* of the pipe body 210*i* in the projections 217*i*. In an embodiment, the length of the micro grooves 2215*i* is about half of the length of the pipe body 210*i* including the projections 217*i*. However, embodiments are not limited in this regard. In an embodiment, the length of micro grooves 2215*i* is greater than half the length of the pipe body 210*a*, but the micro grooves 2215*i* do not contact the closed end 213*i*. In another embodiment, the length of the micro grooves 2215*i* is less than half the length of the pipe body 210*a*. In yet another embodiment, the micro grooves 2215*i* in one capillary element 2200*m* and the micro grooves 2215*i* in the other capillary element 2200*m* may have different lengths.

In the aforementioned embodiments of the heat pipes in FIGS. 13-23, the second capillary structures may include either a metal mesh, a sintered solid part made of metal powder, a sintered ceramic, multiple micro grooves, a combination thereof, and the like.

Figure 24:
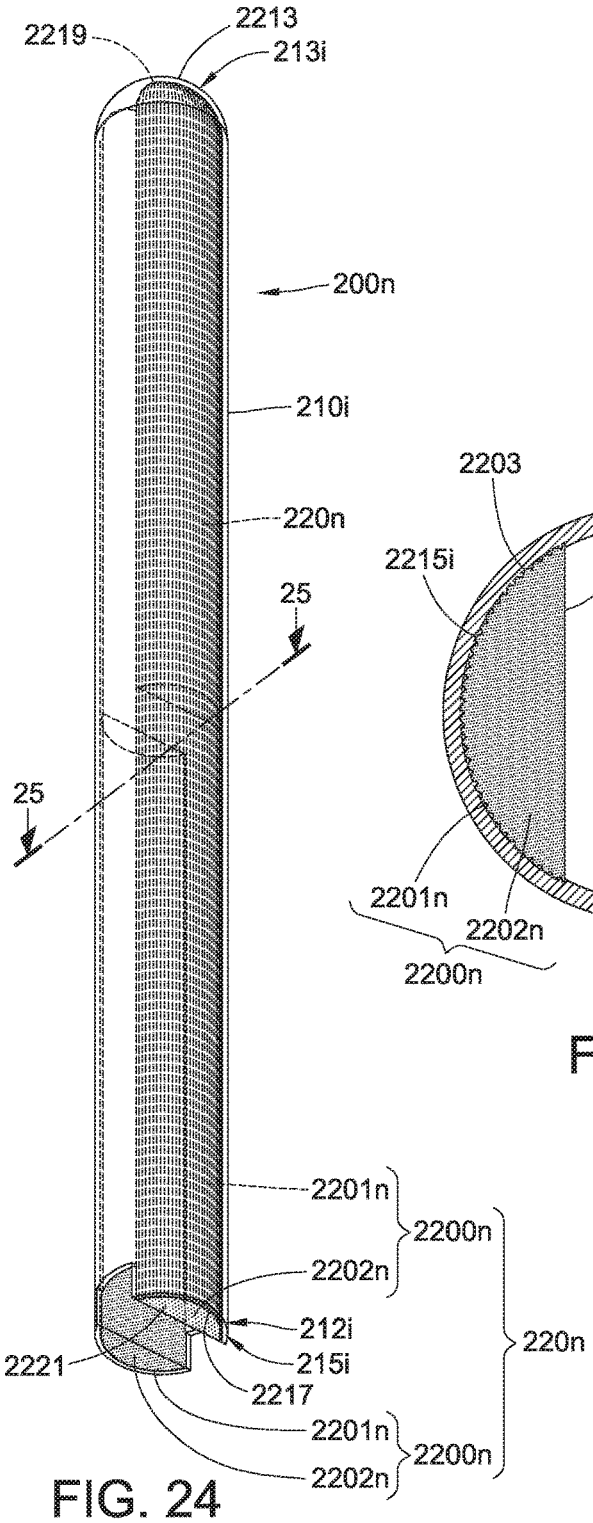
FIG. 24 is a perspective view of a heat pipe, according to example embodiments.
Figure 25:
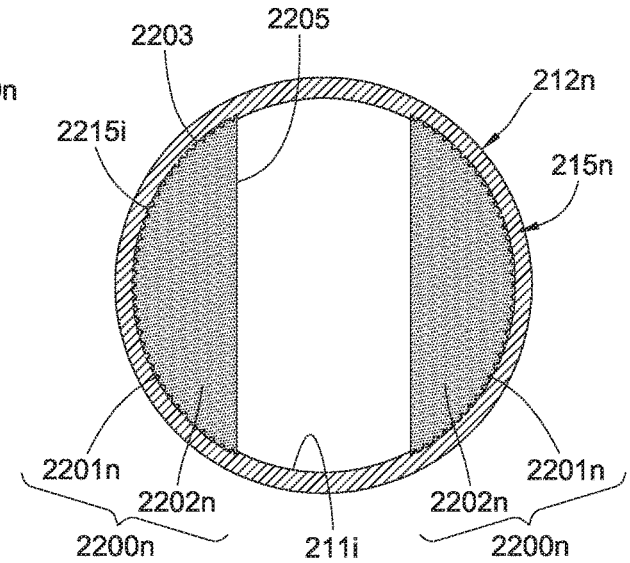
FIG. 25 is a cross-sectional view of the heat pipe in FIG. 24.

FIG. 24 is a perspective view of a heat pipe 200*n* according to example embodiments. FIG. 25 is a cross-sectional view of the heat pipe 200*n* in FIG. 24. The heat pipe 200*n* may be similar in some respects to the heat pipe 200*k* in FIG. 22, and therefore may be best understood with reference thereto where like numerals designate like components not described again in detail.

Referring to FIGS. 24 and 25, the heat pipe 200*n* includes a second capillary structure 220*n* that includes two capillary elements 2200*n* disposed on and contacting the inner circumferential surface 211*i* of the pipe body 210*i*.

The second capillary structure 220*n* is a composite capillary structure. Each capillary element 2200*n* includes a curved or arched surface 2203 contacting the inner circumferential surface 211*i* and a generally planar surface 2205 extending between ends of the curved surface 2203. The capillary element 2200*n* includes a first layer 2201*n* disposed on the curved surface 2203 and a second layer 2202*n* disposed on the first layer 2201*n* and including the planar surface 2205. The first layer 2201*n* includes multiple micro grooves 2215*i*. An axial end 2213 of the first layer 2201*n* contacts the interior surface of the heat pipe 200*n* at the close end 213*n*, and the other axially opposite end 2217 of the first layer 2201*n* is flush with the edge 215*n* of the pipe body 210*n*. The second layer 2202*n* includes a metal mesh, a sintered solid part made of metal powder or a sintered ceramic. An axial end 2219 of the second layer 2202*n* contacts the interior surface of the heat pipe 200*n* at the close end 213*n*, and the other axially opposite end 2221 of the second layer 2202*n* is flush with the edge 215*n* of the pipe body 210*n*.

Figure 26:
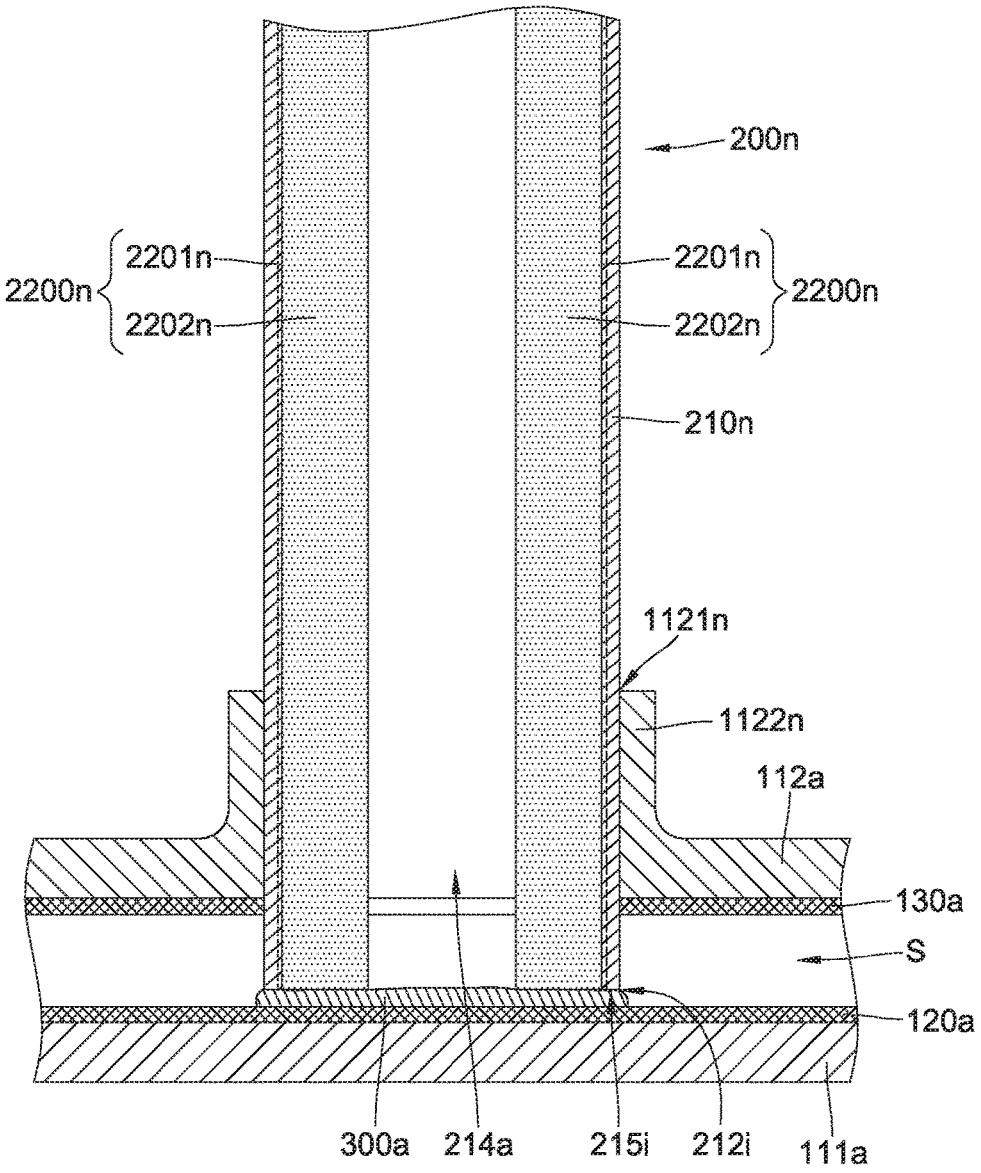
FIG. 26 is a cross-sectional view of the heat pipe in FIG. 24 connected to a vapor chamber, according to example embodiments.

FIG. 26 is a cross-sectional view of the heat pipe 200*n* in FIG. 24 connected to a vapor chamber, according to example embodiments. In an embodiment, the vapor chamber may be similar in some respects to the vapor chamber 100*a* in FIGS. 8-11. In an embodiment, the heat pipe 200*n* is inserted through a through hole 1121*n* of second plate 112*a*. Both the first layer 2201*n* and the second layer 2202*n* of the second capillary structure 220*n* are connected to the first capillary structure 120*a* (FIG. 8) via bonding layer 300*a*. More specifically, the bonding layer 300*a* is connected to the first capillary structure 120*a* and the second capillary structure 220*n* by metallic bonding.

Figure 27:
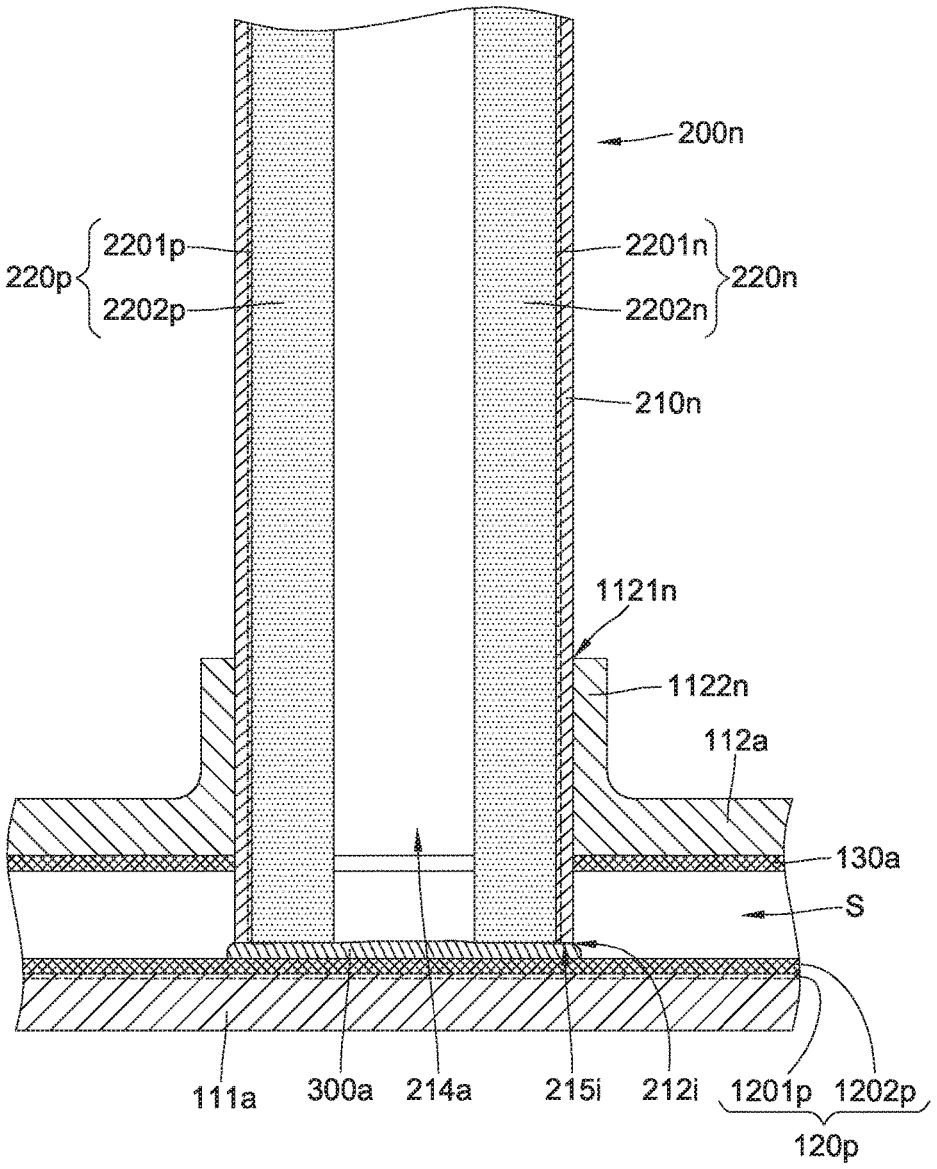
FIG. 27 is a cross-sectional view of the heat pipe coupled to a vapor chamber, according to example embodiments.

FIG. 27 is a cross-sectional view of the heat pipe 200*n* coupled to a vapor chamber 100*p*, according to example embodiments. The vapor chamber 100*p* may be similar in some respects to the vapor chamber 100*a* in FIGS. 8-11, and therefore may be best understood with reference thereto where like numerals designate like components not described again in detail. The vapor chamber includes a first capillary structure 120*p* in the first plate 111*a*. The first capillary structure 120*p* is a composite capillary structure including a first layer 1201*p* and a second layer 1202p. The first layer 1201*p* contact the bottom part 115 of the first plate 111*a*, and the second layer 1202*p* is disposed on the first layer 1201*p*. The first layer 1201*p* includes multiple micro grooves, and the second layer 1202*p* of the first capillary structure 120*p* includes a metal mesh, a sintered solid part made of metal powder or a sintered ceramic. Both a first layer 2201*n* and a second layer 2202*n* of a second capillary structure 220*n* are connected to the second layer 1202*p* of the first capillary structure 120*p* via a bonding layer 300*a*. More specifically, the bonding layer 300*p* is connected to the first layer 2201*n*, the second layer 2202*n*, and the second layer 1202*p* by metallic bonding.

In a conventional heat dissipation devices, the first capillary structure merely contacts the second capillary structure without metal bonding, and the working fluid is retained in the second capillary structure due to an adhesive force between the working fluid and the second capillary structure. According to example embodiments, the first capillary structure is coupled to the second capillary structure by metallic bonding. The metallic bonding encourages flow of the working fluid from the second capillary structure into the first capillary structure. Therefore, a flow rate of the working fluid is increased and the heat dissipation efficiency of the 3D heat transfer device is improved.

It is to be understood that the above descriptions are merely the preferable embodiment of the present disclosure and are not intended to limit the scope of the present disclosure. Equivalent changes and modifications made in the spirit of the present disclosure are regarded as falling within the scope of the present disclosure.

What is claimed is:

1. A three-dimensional heat transfer device, comprising:

a vapor chamber comprising a chamber body and a first capillary structure, and the first capillary structure being disposed in the chamber body; and a heat pipe comprising a pipe body and a second capillary structure, and the second capillary structure being disposed in the pipe body, wherein the first capillary structure is connected to the second capillary structure by metallic bonding.

2. The three-dimensional heat transfer device according to claim 1, further comprising a bonding layer, wherein a side of the bonding layer is connected to the first capillary structure by metallic bonding, and another side of the bonding layer is connected to the second capillary structure by metallic bonding.

3. The three-dimensional heat transfer device according to claim 2, wherein the bonding layer includes gold powder, silver powder, copper powder, or iron powder.

4. The three-dimensional heat transfer device according to claim 2, wherein both the first capillary structure and the second capillary structure are selected from the group consisting of metal mesh, sintered metal powder, sintered ceramic and combination thereof.

5. The three-dimensional heat transfer device according to claim 4, wherein an open end of the pipe body comprises an opening and an edge forming the opening, and the second capillary structure is flush with the edge.

6. The three-dimensional heat transfer device according to claim 5, wherein the open end of the pipe body includes a recess defined on the edge, and the recess is in fluid communication with the opening.

7. The three-dimensional heat transfer device according to claim 5, wherein a closed end of the pipe body is opposite to the open end of the pipe body, and the second capillary structure contacts the closed end.

8. The three-dimensional heat transfer device according to claim 5, wherein a closed end of the pipe body is opposite to the open end of the pipe body, and the second capillary structure is axially spaced apart from the closed end.

9. The three-dimensional heat transfer device according to claim 7, wherein the pipe body comprises an inner circumferential surface, the second capillary structure is disposed on the inner circumferential surface, and the second capillary structure extends circumferentially along the inner circumferential surface.

10. The three-dimensional heat transfer device according to claim 8, wherein the pipe body comprises an inner circumferential surface, the second capillary structure is disposed on the inner circumferential surface, and the second capillary structure extends circumferentially along the inner circumferential surface.

11. The three-dimensional heat transfer device according to claim 7, wherein the pipe body comprises an inner circumferential surface, the second capillary structure comprises two capillary elements disposed on the inner circumferential surface, and the two capillary elements are spaced apart from each other.

12. The three-dimensional heat transfer device according to claim 8, wherein the pipe body comprises an inner circumferential surface, the second capillary structure comprises two capillary elements disposed on the inner circumferential surface, and the two capillary elements are spaced apart from each other.

13. The three-dimensional heat transfer device according to claim 4, wherein an open end of the pipe body comprises an opening and an edge forming the opening, and the second capillary structure comprises a contact portion extending from the edge of the pipe body, the contact portion being exposed.

14. The three-dimensional heat transfer device according to claim 13, wherein a closed end of the pipe body is opposite to the open end of the pipe body, and the second capillary structure contacts the closed end.

15. The three-dimensional heat transfer device according to claim 13, wherein a closed end of the pipe body is opposite to the open end of the pipe body, and the second capillary structure is spaced apart from the closed end.

16. The three-dimensional heat transfer device according to claim 14, wherein the pipe body comprises an inner circumferential surface, the second capillary structure is disposed on the inner circumferential surface, and the second capillary structure extends circumferentially along the inner circumferential surface.

17. The three-dimensional heat transfer device according to claim 15, wherein the pipe body comprises an inner circumferential surface, the second capillary structure is disposed on the inner circumferential surface, and the second capillary structure extends circumferentially along the inner circumferential surface.

18. The three-dimensional heat transfer device according to claim 14, wherein the pipe body comprises an inner circumferential surface, the second capillary structure comprises two capillary elements disposed on the inner circumferential surface, and the two capillary elements are spaced apart from each other.

19. The three-dimensional heat transfer device according to claim 15, wherein the pipe body comprises an inner circumferential surface, the second capillary structure comprises two capillary elements disposed on the inner circumferential surface, and the two capillary elements are spaced apart from each other.

20. The three-dimensional heat transfer device according to claim 2, wherein the first capillary structure and the second capillary structure are selected from the group consisting of metal mesh, sintered metal powder, sintered ceramic, micro grooves and combination thereof.

21. The three-dimensional heat transfer device according to claim 20, wherein an open end of the pipe body comprises an opening and an edge forming the opening, and the second capillary structure is flush with the edge.

22. The three-dimensional heat transfer device according to claim 21, wherein the open end of the pipe body comprises a recess located on the edge, and the recess is in fluid communication with the opening.

23. The three-dimensional heat transfer device according to claim 21, wherein a closed end of the pipe body is opposite to the open end of the pipe body, and the second capillary structure contacts the closed end.

24. The three-dimensional heat transfer device according to claim 21, wherein a closed end of the pipe body is opposite to the open end of the pipe body, and the second capillary structure is axially spaced apart from the close end.

25. The three-dimensional heat transfer device according to claim 23, wherein the pipe body comprises an inner circumferential surface, the second capillary structure is disposed on the inner circumferential surface, and the second capillary structure extends circumferentially along the inner circumferential surface.

26. The three-dimensional heat transfer device according to claim 24, wherein the pipe body comprises an inner circumferential surface, the second capillary structure is disposed on the inner circumferential surface, and the second capillary structure extends circumferentially along the inner circumferential surface.

27. The three-dimensional heat transfer device according to claim 23, wherein the pipe body comprises an inner circumferential surface, the second capillary structure comprises two capillary elements disposed on the inner circumferential surface, and the two capillary elements are spaced apart from each other.

28. The three-dimensional heat transfer device according to claim 24, wherein the pipe body comprises an inner circumferential surface, the second capillary structure comprises two capillary elements disposed on the inner circumferential surface, and the two capillary elements are spaced apart from each other.

29. The three-dimensional heat transfer device according to claim 1, wherein the chamber body of the vapor chamber comprises a first plate and a second plate, the first plate is connected to the second plate, the first plate and the second plate jointly define a cavity, the second plate comprises an through hole and a flange extending from the through hole, the heat pipe being received in the through hole, and the flange surrounding the heat pipe.

30. The three-dimensional heat transfer device according to claim 29, wherein the first capillary structure is disposed on a surface of the first plate facing the cavity.

31. The three-dimensional heat transfer device according to claim 30, further comprising a third capillary structure disposed on a surface of the second plate facing the cavity.

32. The three-dimensional heat transfer device according to claim 1, further comprising a fins assembly disposed on the heat pipe.

33. A three-dimensional heat transfer device, comprising:

a vapor chamber comprising a chamber body and a first capillary structure, and the first capillary structure being disposed in the chamber body;

a heat pipe comprising a pipe body and a second capillary structure, and the second capillary structure being disposed in the pipe body; and a bonding layer connected to the first capillary structure and the second capillary structure, and the bonding layer comprising a porous structure.

34. A method of manufacturing a three-dimensional heat transfer device, comprising:

providing a vapor chamber including a first capillary structure;

providing a metal powder on at least a part of the first capillary structure;

contacting a heat pipe including a second capillary structure to the metal powder; and performing a sintering process to sinter the metal powder to form a bonding layer, wherein the bonding layer is connected to the first capillary structure and the second capillary structure by metallic bonding.

35. A method of manufacturing a three-dimensional heat transfer device, comprising:

providing a vapor chamber comprising a first capillary structure;

providing a metal powder on at least part of the first capillary structure;

contacting a heat pipe including a second capillary structure on the metal powder; and performing a sintering process to sinter the metal powder to form a bonding layer comprising a porous structure, wherein the bonding layer is connected to the first capillary structure and the second capillary structure.

* * * * *